US007277063B2

(12) United States Patent
Shirosaka et al.

(10) Patent No.: US 7,277,063 B2
(45) Date of Patent: Oct. 2, 2007

(54) VARIABLE DIRECTIVITY ANTENNA AND VARIABLE DIRECTIVITY ANTENNA SYSTEM USING THE ANTENNAS

(75) Inventors: Toshiaki Shirosaka, Kobe (JP); Shingo Fujisawa, Kobe (JP); Toshio Fujita, Kobe (JP); Kiyotaka Tatekawa, Kobe (JP); Eiji Shibuya, Kobe (JP)

(73) Assignee: DX Antenna Company, Limited, Kobe-Shi (JP)

( * ) Notice: Subject to any disclaimer, the term of this patent is extended or adjusted under 35 U.S.C. 154(b) by 67 days.

(21) Appl. No.: 10/550,885

(22) PCT Filed: Apr. 1, 2004

(86) PCT No.: PCT/JP2004/004793

§ 371 (c)(1),
(2), (4) Date: Sep. 27, 2005

(87) PCT Pub. No.: WO2004/091043

PCT Pub. Date: Oct. 21, 2004

(65) Prior Publication Data

US 2006/0050005 A1 Mar. 9, 2006

(30) Foreign Application Priority Data

Apr. 2, 2003 (JP) ..... 2003-099639

(51) Int. Cl.
*H01Q 1/50* (2006.01)

(52) U.S. Cl. ..... 343/850

(58) Field of Classification Search ..... 343/850, 343/810, 844, 757, 853, 814, 816, 820, 812
See application file for complete search history.

(56) References Cited

U.S. PATENT DOCUMENTS

| | | | | |
|---|---|---|---|---|
| 5,291,210 | A * | 3/1994 | Nakase | 343/700 MS |
| 6,188,366 | B1 * | 2/2001 | Yamamoto et al. | 343/722 |
| 7,071,891 | B2 * | 7/2006 | Shirosaka et al. | 343/810 |
| 7,116,281 | B2 * | 10/2006 | Rankin | 343/820 |
| 7,158,086 | B2 * | 1/2007 | Inatsugu et al. | 343/711 |

FOREIGN PATENT DOCUMENTS

JP 54-140636 U 9/1979

(Continued)

OTHER PUBLICATIONS

International Search Report from PCT/JP2004/004793 dated Jun. 15, 2004.

*Primary Examiner*—Huedung Mancuso
(74) *Attorney, Agent, or Firm*—Duane Morris LLP

(57) ABSTRACT

Folded dipole antenna elements (2, 4) are disposed generally in parallel, being spaced by a distance smaller than a half of the wavelength employed. The antenna elements (2, 4) are connected to a combiner (16) via feeders (12, 14) having different lengths. The difference in length between the feeders (12, 14) is such that received signals resulting from a radio wave coming to the antenna elements (2, 4) from the front and received by the antenna elements (12, 14) are in phase with each other at the inputs (16*a*, 16*b*) of the combiner (16), whereas received signals resulting from a radio wave coming to the antenna elements (2, 4) from the back and received by the antenna elements (12, 14) are 180° out of phase with each other at the inputs (16*a*, 16*b*) of the combiner (16).

16 Claims, 15 Drawing Sheets

FOREIGN PATENT DOCUMENTS

| | | | |
|---|---|---|---|
| JP | 56-080935 | A | 7/1981 |
| JP | 56-013809 | A | 2/1982 |
| JP | 57-82706 | U | 5/1982 |
| JP | 58-66708 | U | 5/1983 |
| JP | 09-181667 | | 7/1997 |
| JP | 10-191464 | A | 7/1998 |
| JP | 11-231038 | | 8/1999 |
| JP | 2000-236209 | | 8/2000 |
| JP | 2001-217737 | | 8/2001 |
| JP | 2003-008328 | | 1/2003 |

* cited by examiner

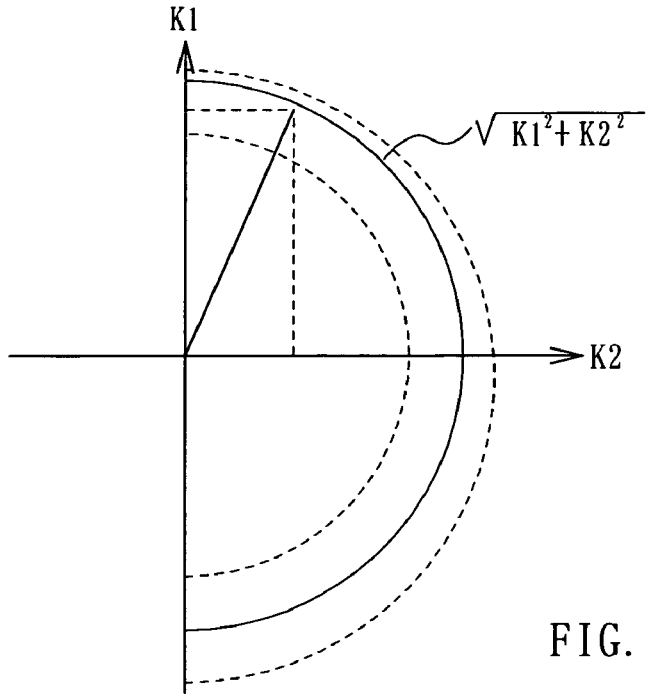
FIG. 9
FIG. 10A
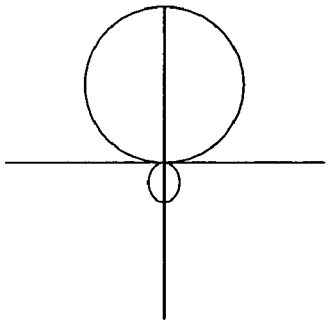
FIG. 10B
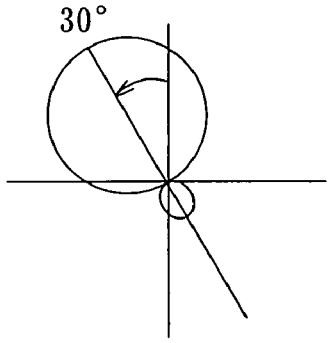
FIG. 10C
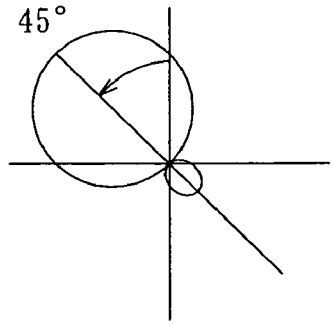
FIG. 10D
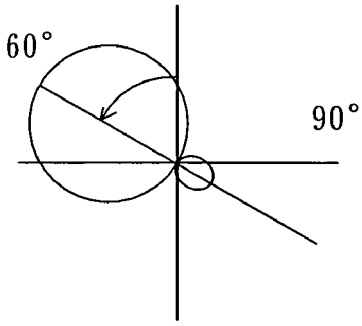
FIG. 10E
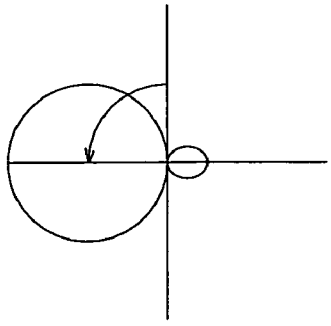
FIG. 10F
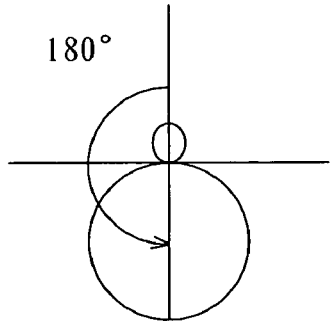

VARIABLE DIRECTIVITY ANTENNA AND VARIABLE DIRECTIVITY ANTENNA SYSTEM USING THE ANTENNAS

This invention relates to a variable directivity antenna and a variable directivity antenna system using such antennas.

BACKGROUND OF THE INVENTION

A directional antenna may be used to receive a radio wave from a particular direction better than waves from other directions. A Yagi antenna is well-known as a directional antenna. A variable directivity antenna is used to selectively receive a desired one of radio waves from various directions. An example of variable directivity antenna is disclosed in Japanese Utility Model Publication No. SHO 63-38574 Y2 published on Oct. 12, 1988.

The variable directivity antenna disclosed in this Japanese UM publication includes first and second antennas which lie to orthogonally intersect with each other in the same horizontal plane. Dipole antennas or folded dipole antennas are used as the first and second antennas. A signal received by the first antenna is applied through a first variable attenuator to a combiner, and a signal received by the second antenna is applied through a second variable attenuator to the combiner. The directivity of the variable directivity antenna can be varied by adjusting the amounts of attenuation provided by the first and second variable attenuators.

A Yagi antenna can receive better a radio wave from a fixed, particular direction, but it cannot receive well radio waves from other directions. The above-described variable directivity antenna has directivity that can rotate, and, therefore, it can receive only a radio wave from a desired direction selected from radio waves from various directions. However, the variable directivity antenna of Japanese Utility Model Publication No. SHO 63-38574 Y2 has an "8"-shaped directivity pattern, and, therefore, the antenna receives also a radio wave from the direction opposite to the desired direction. In other words, the antenna of Japanese Utility Model Publication No. SHO 63-38574 Y2 has a low F/B ratio.

An object of the present invention is to provide a small-sized antenna that has an improved F/B ratio and can selectively receive well radio waves from different two directions. Another object of the present invention is to provide an antenna system that can selectively receive desired ones of radio waves from various directions satisfactorily, by the use of the variable directivity antennas.

DISCLOSURE OF THE INVENTION

A variable directivity antenna according to one embodiment of the present invention has a first antenna group. The first antenna group includes first and second antennas for receiving radio waves in a first frequency band, which exhibit an 8-shaped directivity along a line perpendicular to the length direction of the antennas and are disposed in parallel with each other, being spaced from each other by a distance shorter than a half (½) of the wavelength of the first frequency band. Phase shifting means adjusts the phase of signals received by the first and second antennas and combines them, in such a manner that a resulting combined signal can be in selected one of a first directivity state in which the resultant signal exhibits directivity in a first direction, which is from the first antenna toward the second antenna, and a second directivity state in which the resultant signal exhibits directivity in a second direction, which is from the second antenna toward the first antenna.

The phase shifting means may include combining means to which the received signals from the first and second antennas are coupled. A first fixed phase shifter is disposed between the combining means and the first antenna. Variable phase shifting means is disposed between the second antenna and the said combining means. In the first directivity state, the variable phase shifting means couples the received signal from the second antenna as it is to the combining means, and, in the second directivity state, a second fixed phase shifter is connected between the second antenna and the combining means. The amount of phase shift provided by the first fixed phase shifter is so determined that, in the first directivity state, the received signals coming along the second direction received by the first and second antennas can have substantially opposite phases. The amount of phase shift provided by the second fixed phase shifter is so determined that, in the second directivity state, the received signal from the second antenna can be in substantially opposite phase with the output signal of the first fixed phase shifter.

The received signals from the first and second antennas are amplified respectively in first and second amplifiers and, then, coupled to the phase shifting means.

The first and second antennas may be formed on a single printed circuit board.

The first and second antennas may be first and second dipole antennas having their length so selected as to be able to receive radio waves in the first frequency band. Outward of the opposite ends of each dipole antenna, extension elements are disposed in line with that dipole antenna. The total length of the first dipole antenna and its extension elements disposed outward of the opposite ends of the first dipole antenna is determined such as to be able to receive radio waves in a second frequency band, which is lower than the first frequency band. The total length of the second dipole antenna and its extension elements disposed outward of the opposite ends of the second dipole antenna is determined such as to be able to receive radio waves in the second frequency band. Switching means are disposed between the first dipole antenna and the extension elements disposed outward of the opposite ends of the first dipole antenna, and between the second dipole antenna and the extension elements disposed outward of the opposite ends of the second dipole antenna.

A variable directivity antenna according to another embodiment of the present invention has first and second antenna groups. The first antenna group includes first and second antennas for receiving radio waves in a first frequency band, which exhibit an 8-shaped directivity along a line perpendicular to the length direction of the antennas and are disposed in parallel with each other, being spaced from each other by a distance shorter than a half (½) of the wavelength of the first frequency band. The second antenna group includes third and fourth antennas for receiving a radio wave in the first frequency band, which exhibit an 8-shaped directivity along a line perpendicular to the length direction of the third and fourth antennas and are disposed in parallel with each other, being spaced from each other by the said distance. The third and fourth antennas are disposed perpendicular to the first and second antennas. First phase shifting means adjusts the phase of received signals from the first and second antennas and combines them, in such a manner that a resulting combined signal can be in selected one of a first directivity state in which the resultant signal exhibits directivity in a first direction, which is from the first antenna toward the second antenna, and a second directivity state in which the resultant signal exhibits directivity in a second direction, which is from the second antenna toward the first antenna. Second phase shifting means adjusts the phase of received signals from the third and fourth antennas and combines them, in such a manner that a resulting combined signal can be in selected one of a third directivity state in which the resultant signal exhibits directivity in a third direction, which is from the third antenna toward the fourth antenna, and a fourth directivity state in which the resultant signal exhibits directivity in a fourth direction, which is from the fourth antenna toward the third antenna. Signal combining means adjusts the value of an output signal of the first phase shifting means in the first or second directivity state and the value of an output signal of the second phase shifting means in the third or fourth directivity state, combines the adjusted output signals, and develops an output signal exhibiting selective one of directivities in the first through fourth directions and directions between the respective ones of the first through fourth directions.

The signal combining means may include first level adjusting means, to which an output signal of the first phase shifting means is coupled. In this arrangement, an output signal of the second phase shifting means is coupled to second level adjusting means. Output signals of the first and second level adjusting means are combined in combining means. Each of the first and second level adjusting means is adapted to selectively assume a first factor state in which a signal inputted thereto is outputted with a level proportional to a first factor, a second factor state in which a signal inputted thereto is outputted with a level proportional to a second factor smaller than the first factor, and an intercepting state in which a signal inputted thereto is intercepted. Level control signal generating means provides first and second level control signals to first and second adjusting means. The first and second level control signals are switched successively to a first step in which the first level adjusting means assumes the first factor state and the second level adjusting means assumes the intercepting state, a second step in which the first level adjusting means assumes the first factor state and the second level adjusting means assumes the second factor state, a third step in which the first and second level adjusting means assume the first factor state, a fourth step in which the first level adjusting means assumes the second factor state and the second level adjusting means assumes the first factor state, a fifth step in which the first level adjusting means assumes the intercepting state and the second level adjusting means assumes the first factor state, a sixth step in which the first level adjusting means assumes the second factor state and the second level adjusting means assumes the first factor state, a seventh step in which the first and second level adjusting means assume the first factor state, and an eighth step in which the first level adjusting means assumes the first factor state and the second level adjusting means assumes the second factor state.

Directivity control signal generating means provides directivity control signals to the first and second antenna groups to change the directivities of the first and second antenna groups. In the first through fourth steps, the directivity control signals selectively place the directivities of the first and second antenna groups in a state in which the directivity of the first antenna group is in the first directivity state and the directivity of the second antenna group is in the third directivity state, and a state in which the directivity of the first antenna group is in the second directivity state and the directivity of the second antenna group is in the fourth directivity state. Further, in the fifth through eighth steps, the directivity control signals selectively place the directivities of the first and second antenna groups in a state in which the directivity of the first antenna group is in the second directivity state and the directivity of the second antenna group is in the third directivity state, and a state in which the directivity of the first antenna group is in the first directivity state and the directivity of the second antenna group is in the fourth directivity state.

The first through fourth antennas may be first through fourth dipole antennas having their length so selected as to be able to receive radio waves in the first frequency band. Outward of the opposite ends of each dipole antenna, extension elements are disposed in line with that dipole antenna. The total length of each of the first through fourth dipole antennas and the extension elements disposed outward of the opposite ends of that dipole antenna is determined such as to be able to receive radio waves in a second frequency band, which is lower than the first frequency band. Switching means are disposed between the first dipole antenna and the extension elements disposed outward of the opposite ends of the first dipole antenna, between the second dipole antenna and the extension elements disposed outward of the opposite ends of the second dipole antenna, between the third dipole antenna and the extension elements disposed outward of the opposite ends of the third dipole antenna, and between the fourth dipole antenna and the extension elements disposed outward of the opposite ends of the fourth dipole antenna, respectively. Switching control means opens the switching means when a radio wave in the first frequency band is to be received, and closes the switching means when a radio wave in the second frequency band is to be received.

Variable filter means may be used. The variable filter means includes a first variable filter which receives the received signals from the first antenna group and has its passband changed selectively to the first and second frequency bands in response to a first passband varying signal, and a second variable filter which receives the received signals from the second antenna group and has its passband changed in response to a second passband varying signal. Passband varying signal generating means provides the first and second passband varying signals to the first and second variable filters.

When the level control signal generating means and said directivity control signal generating means are generating the first and second level control signals and the directivity control signals to provide the antenna system with such a directivity as to receive a desired radio wave, the passband varying signal generating means provides the first and second variable filters with first and second passband varying signals to make the first and second variable filters pass therethrough the desired radio wave.

A receiving apparatus may be provided, to which the received signal is coupled from the antenna system through a transmission path. The receiving apparatus transmits, through the transmission path, antenna control data related to a channel of which the signal to be received is being transmitted through the transmission line.

The receiving apparatus may be provided with memory means for storing therein the antenna control data and data relating to the channels in correlation with each other. The first and second level control signals, the directivity control signals and the first and second passband varying signals for a desired channel are arranged to be generated in accordance with the antenna control data. When the receiving apparatus is receiving the desired channel, the antenna control data for the desired channel is read out of the memory means and transmitted through the transmission line to the level control signal generating means, the directivity control signal generating means and the passband varying signal generating means.

After the receiving apparatus is set to receive the desired channel, the first and second passband varying signals are applied to the first and second variable filters to make them pass the desired channel signal therethrough, and, while monitoring the receiving condition at the receiving apparatus, the first and second level control signals and the directivity control signals are changed to determine the first and second level control signals and the directivity control signals when an allowable receiving condition is attained. The data piece relating to the thus determined first and second level control signals and directivity control signals, and the data piece relating to the first and second passband varying signals applied by the passband varying signal generating means, are stored in the memory means as the antenna control data.

When the receiving condition for the desired channel signal at the receiving apparatus becomes intolerable, with the first and second passband varying signals being applied to the first and second variable filters to make them pass the desired channel signal therethrough, the first and second level control signals and the directivity control signals are successively changed, with the receiving condition at the receiving apparatus being monitored, and the first and second level control signals and the directivity control signals attained when the allowable receiving condition at the receiving apparatus is realized. The first and second level control signals and the directivity control signals attained in the allowable receiving condition are substituted for the previous data in the antenna control data relating to the first and second level control signals and the directivity control signals.

Received signals from the first through fourth antenna elements may be amplified in associated amplifying means.

The first and second antenna elements may be formed on a first printed circuit board, with the third and fourth antenna elements formed on a second printed circuit board.

BRIEF DESCRIPTION OF THE DRAWINGS

FIG. 9 shows changes of two factors used in a variable attenuator in the antenna system of FIG. 8.

FIGS. 10A, 10B, 10C, 10D, 10E, and 10F show changes of the directivity of the antenna system of FIG. 8.

BEST MODE FOR PRACTICING THE INVENTION

Figure 1:
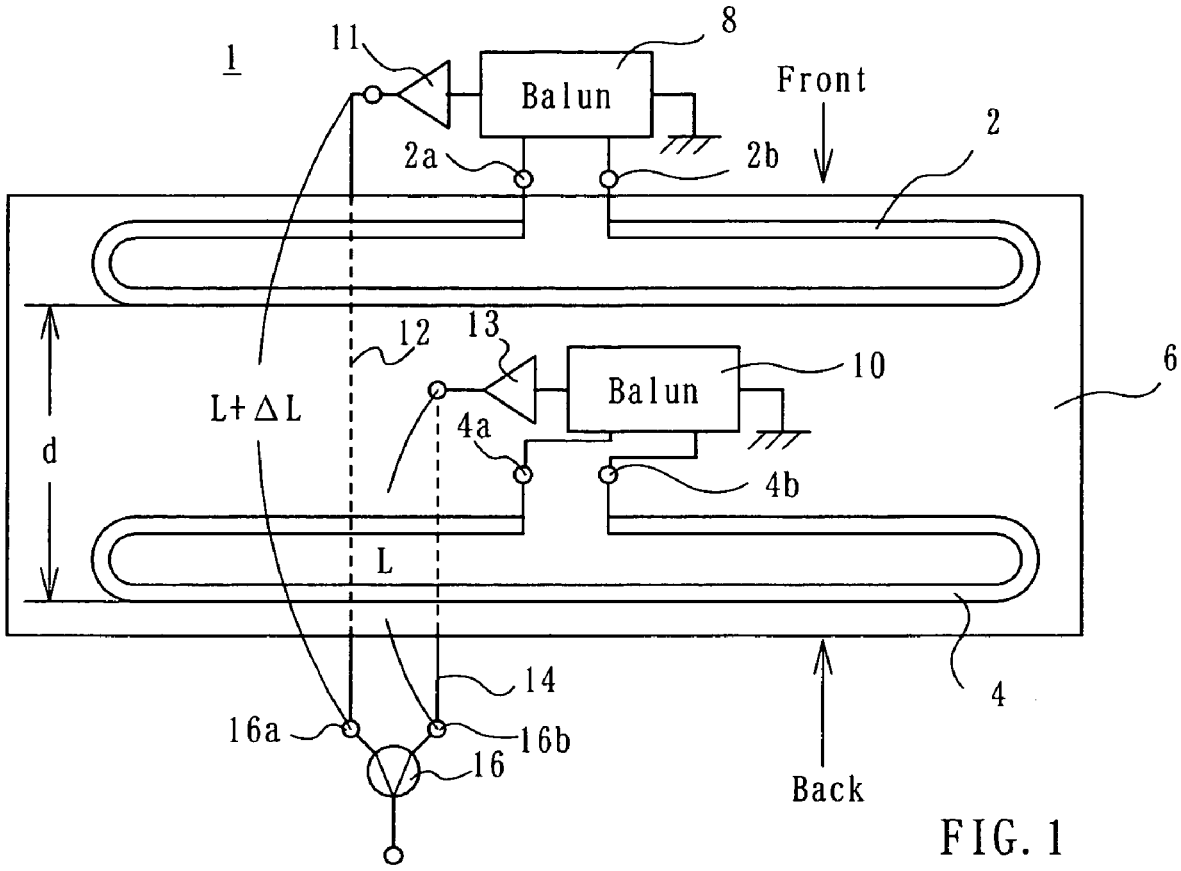
FIG. 1 is a plan view of a variable directivity antenna according to a first embodiment of the present invention.

A variable directivity antenna 1 according to a first embodiment of the present invention may be used to receive a radio wave in a first frequency band, e.g. in the UHF band (470-890 MHz) used for television broadcasting. As shown in FIG. 1, the antenna 1 has plural, e.g. two, antenna elements 2 and 4. The antenna elements 2 and 4 are folded dipole antennas of which the entire length is, for example, about 20 cm that is equal to about one-half of the wavelength A at the center frequency, 620 MHz, of the UHF band. The two antenna elements 2 and 4 are disposed in parallel with each other with a predetermined distance d disposed therebetween. The distance d may be, for example, 20 mm, that is equal to about $\lambda/20$. The antenna elements 2 and 4 are planar type elements that are formed by etching a metal film on a printed circuit board 6.

Feeding points 2*a* and 2*b* disposed in the center portion of the antenna element 2 are coupled to a matching device, for example, a balun 8. Similarly, feeding points 4*a* and 4*b* in the center portion of the antenna element 4 are coupled to a balun 10. The baluns 8 and 10 may be formed on the printed circuit board 6, too, together with the antenna elements 2 and 4. The outputs of the baluns 8 and 10 are amplified in amplifiers 11 and 13, respectively. The amplifiers 11 and 13 may be formed on the printed circuit board 6, too. The outputs of the amplifiers 11 and 13 are coupled through feeders 12 and 14 to inputs 16*a* and 16*b*, respectively, of combining means, e.g. a combiner 16. Combining the signals from the antenna elements 2 and 4 after they are amplified by the amplifiers 11 and 13, provides a better C/N ratio than amplifying the combiner output. The lengths of the feeders 12 and 14 are different from each other. For example, the feeder 12 may have a length of $L+\Delta L$, whereas the feeder 14 may have a length of L. In other words, the feeder 12 has a length larger by $\Delta L$ than the feeder 14.

The value $\Delta L$ is determined in the following way. Let it be assumed that the side of the antenna 1 on which the antenna element 2 is disposed is the front side, and the side of the antenna 1 on which the antenna element 4 is disposed is the back side. A radio wave coming from a second direction, i.e. coming from the back, in parallel with the surface of the printed circuit board 6 and perpendicularly to the length direction of the antenna elements 2 and 4, is received by the antenna elements 2 and 4 and propagates through the feeders 12 and 14 to the inputs 16*a* and 16*b* of the combiner 16, respectively. The signal resulting from the radio wave from the second direction as received by the antenna element 2 has its phase delayed from the signal resulting from the same radio wave as received by the antenna element 4, by an amount corresponding to the distance d between the antenna elements 2 and 4, and reaches the input 16*a* of the combiner 16, being delayed by an amount corresponding to ΔL, the difference in length between the feeders 12 and 14. In other words, the signal based on the radio wave from the second direction received by the antenna element 2 has its phase delayed from the signal based on the same radio wave received by the antenna element 4, by an amount corresponding to ΔL+d, when they reach the inputs 16*a* and 16*b* of the combiner 16, respectively. The value ΔL is determined such that the two signals at the inputs of the combiner 16 are opposite in phase.

A radio wave coming from a first direction, i.e. coming from the front, in parallel with the surface of the printed circuit board 6 and perpendicularly to the length direction of the antenna elements 2 and 4, is received by the antenna elements 2 and 4 and propagates through the feeders 12 and 14 to the inputs 16*a* and 16*b* of the combiner 16, respectively. The signal resulting from the radio wave from the first direction as received by the antenna element 4 has its phase delayed from the signal resulting from the same radio wave from the first direction as received by the antenna element 2, by the amount corresponding to the distance d between the antenna elements 2 and 4. The delay is reduced by ΔL.

For example, ΔL is determined such as to provide a delay corresponding to about 0.37λ. Then, although the radio wave from the first direction or front received by the antenna element 4 has a phase difference of +λ/20 (=0.05λ) relative to the same radio wave from the front received by the antenna element 2, the signals from the antennas 2 and 4 resulting from that radio wave are combined with a phase difference equal to 0.32λ (=0.37λ−0.05λ) because they propagate through the feeders 12 and 14 before reaching the inputs 16*a* and 16*b* of the combiner 16. Also, the radio wave from the second direction or back received by the antenna element 4 has a phase difference of −0.05λ relative to the same radio wave from the back received by the antenna element 2. The signal from the antenna element 2 is provided with a delay of −0.37λ when it is transmitted through the feeder 12, and exhibits a phase difference of −0.42λ (=−0.05λ−0.37λ) relative to the signal from the antenna element 4 at the input 16*a* of the combiner 16. This phase difference is approximately Δ/2, and, therefore, the signal from the back of the antenna 1 is substantially cancelled.

Then, the signals resulting from the radio wave from the front of the antenna 1 received by the antenna elements 2 and 4 are combined with a reduced phase difference, whereas the signals resulting from the radio wave from the back received by the antenna elements 2 and 4 are combined, being substantially oppositely phased. As a result, the antenna 1 operates as a directional antenna with no backward main lobe. Generally, if the lengths of the feeders from the antenna elements 2 and 4 to the combiner 16 are equal, the distance d between the antenna elements 2 and 4 must be λ/4 in order to couple signals resulting from a radio wave from the front as received by the antenna elements 2 and 4, in phase with each other to the inputs 16*a* and 16*b* of the combiner 16, and to couple signals resulting from a radio wave from the back as received by the antenna elements 2 and 4, in opposite phase to the inputs 16*a* and 16*b* of the combiner 16. Such larger distance d of λ/4 makes the antenna larger. In contrast, according to the first embodiment of the present invention, the distance d between the antenna elements 2 and 4 can be smaller, e.g. λ/20, than λ/4 because the difference of ΔL is provided between the length of the feeder 12 and the length of the feeder 14, and, therefore, the size of the antenna 1 can be smaller.

Figure 3:
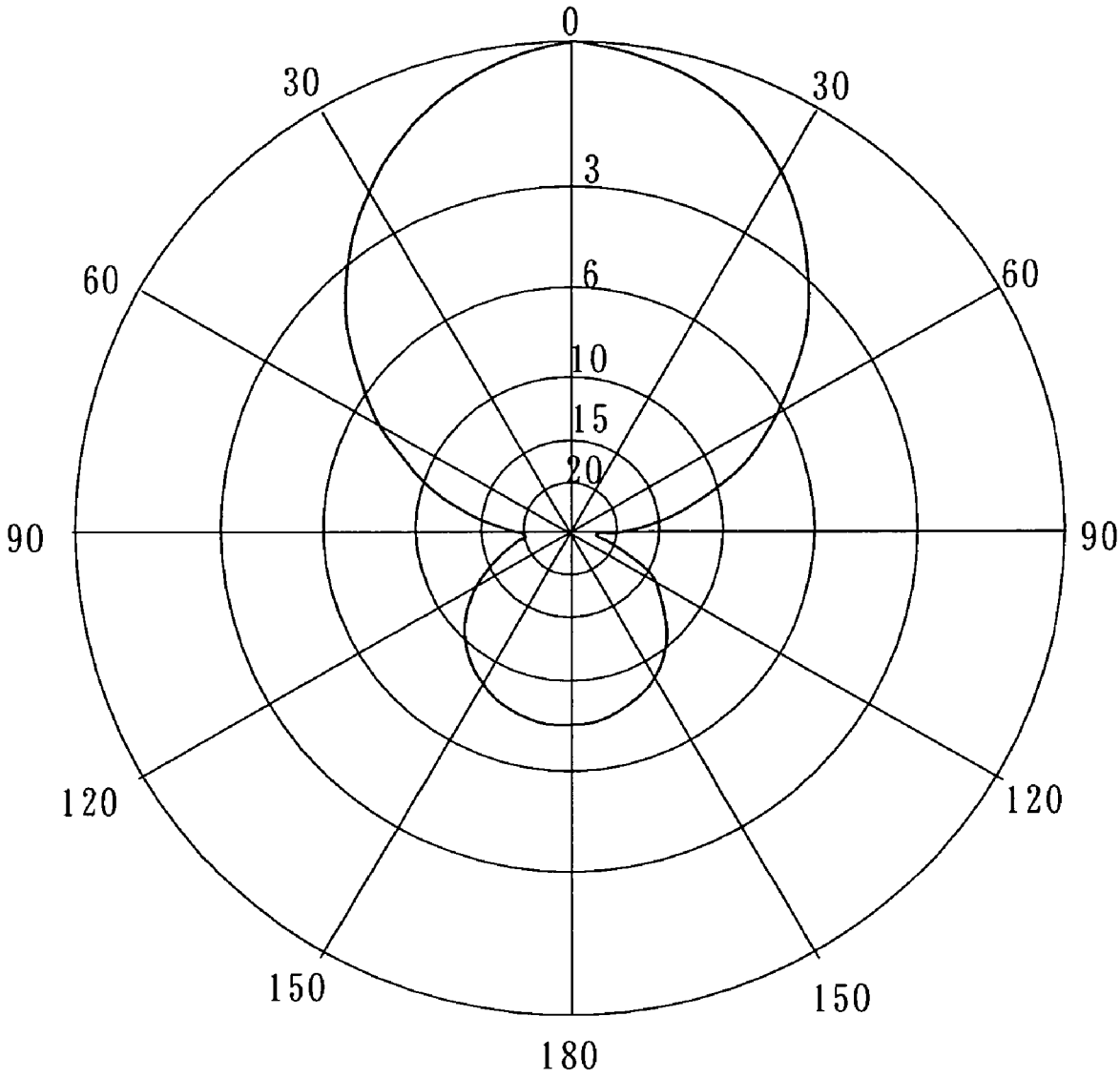
FIG. 3 shows a horizontal directivity pattern of the antenna of FIG. 1.
Figure 4:
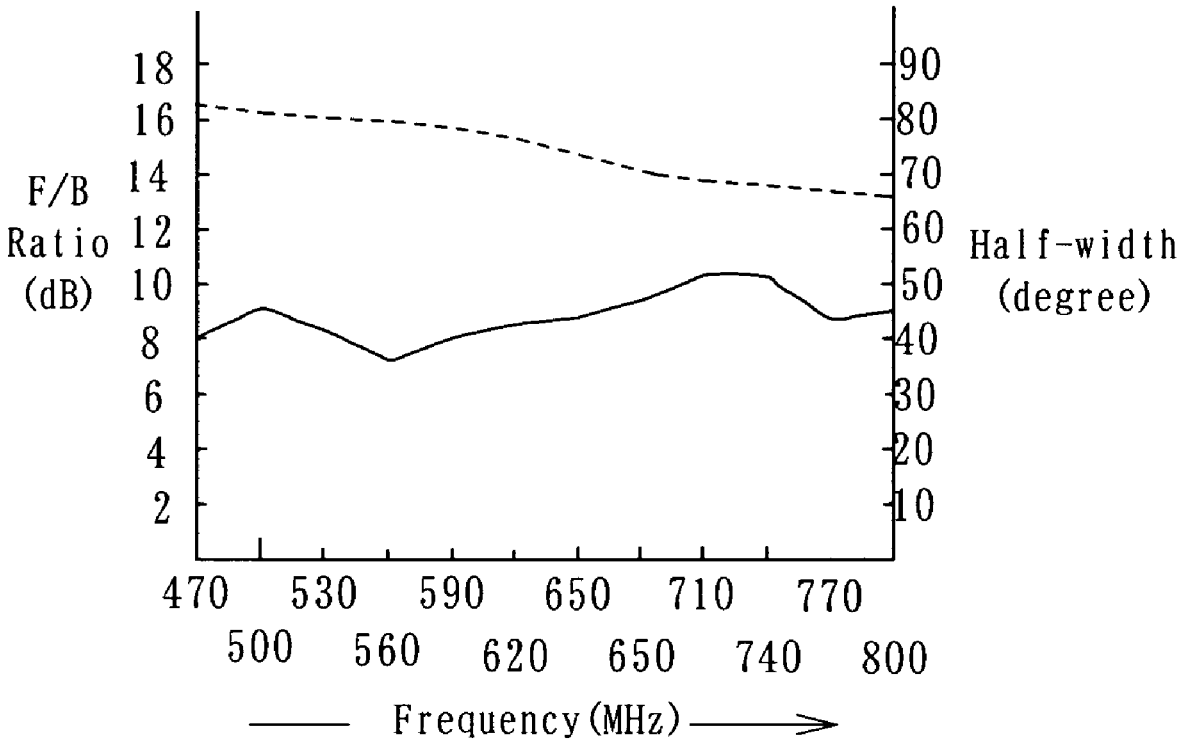
FIG. 4 shows F/B ratio versus frequency and half-width versus frequency characteristics of the antenna of FIG. 1.
Figure 5:
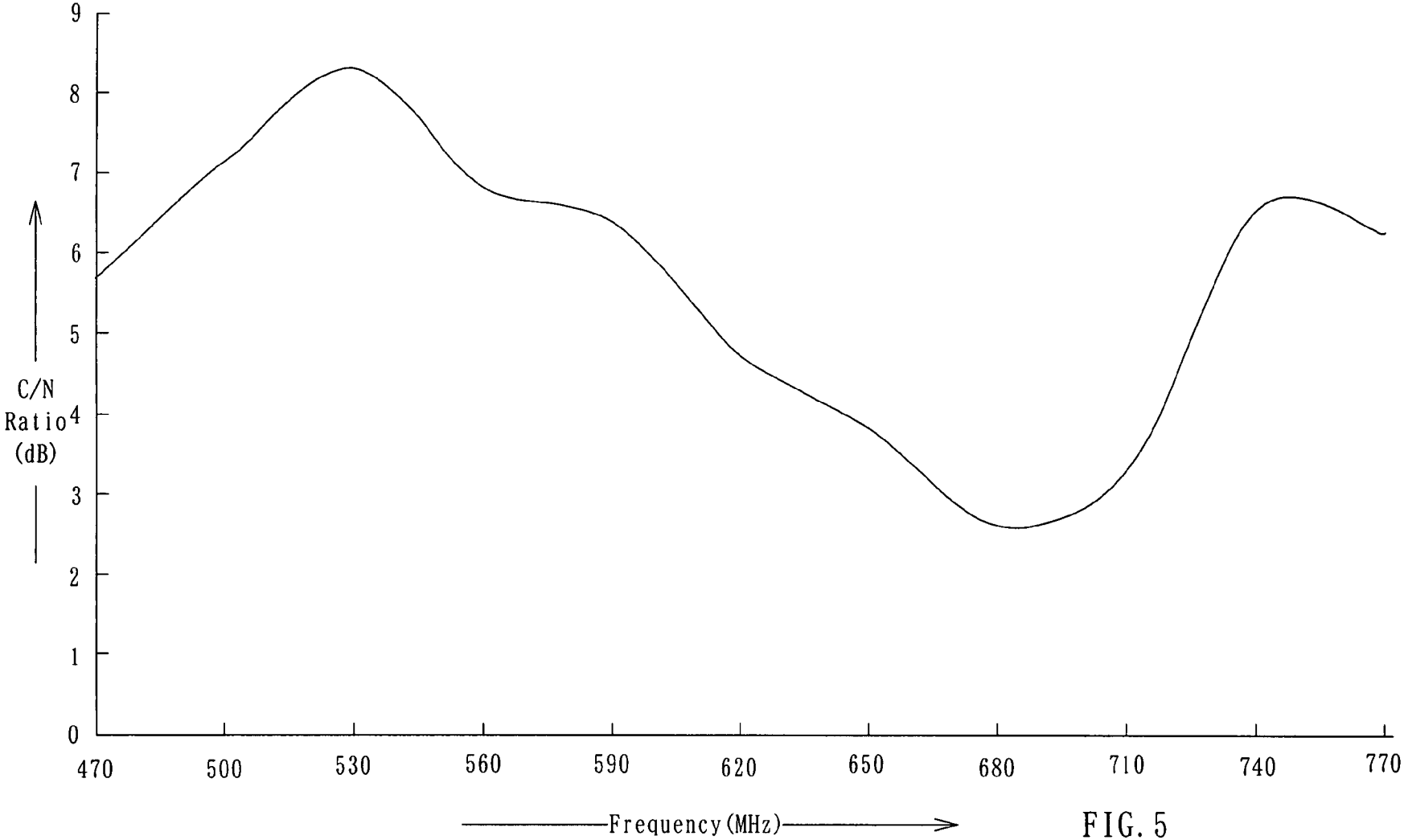
FIG. 5 shows a C/N ratio versus frequency characteristic of the antenna of FIG. 1.

FIG. 3 shows a horizontal directivity pattern of the antenna 1 at 470 MHz. As is understood from this pattern, the antenna 1 exhibits a large F/B ratio of, for example, 8.1 dB and, therefore, can receive radio waves from the front of the antenna 1 better than radio waves from the back. Also, the antenna 1 exhibits a half-width at about 82°. FIG. 4 shows the F/B ratio versus frequency characteristic of the antenna 1 and also the half-width versus frequency characteristic. The solid line is for the F/B ratio, and the broken line is for the half-width. As is seen, the F/B ratio is within a range of from about 7.5 dB to about 11 dB, which is sufficiently practically usable in the entire UHF band. Also, the half-width is within a range of from about 68° to about 82°, which is also practically useable in the entire UHF band. FIG. 5 shows the C/N ratio versus frequency characteristic of the antenna 1 relative to the antenna 1 with the amplifiers 11 and 13 removed. As is seen from FIG. 5, the use of the amplifiers 11 and 13 improves the C/N ratio by about 2.8 dB at the worst. The highest frequency of the UHF band shown in FIGS. 4 and 5 is about 800 MHz. In U.S.A., however, the highest frequency of the UHF band actually utilized is 806 MHz, and, therefore, FIGS. 4 and 5 clearly show that the antenna 1 is useful in receiving radio waves in the UHF band.

Figure 2:
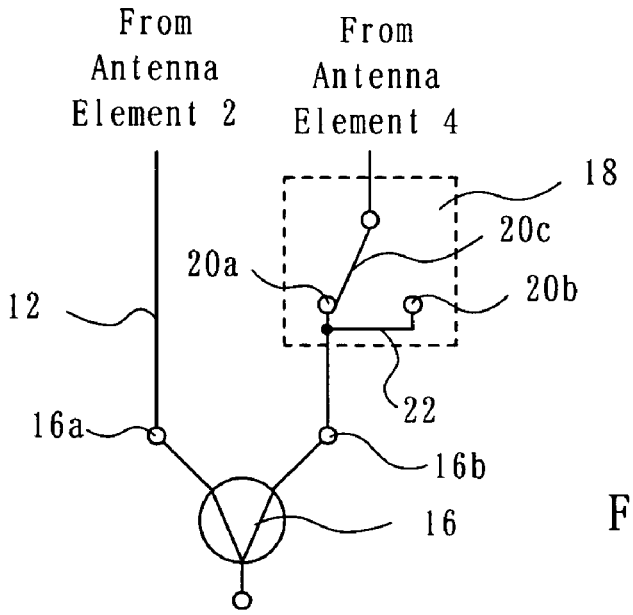
FIG. 2 is a circuit diagram of part of the antenna shown in FIG. 1.

The antenna 1 with the above-described arrangement is adapted to receive well only a radio wave coming from the front side of the antenna 1. However, it may become necessary for the antenna 1 to receive a radio wave coming thereto from the back. For that purpose, variable phase means, for example, a variable phase device 18 is connected to the input 16*b* of the combiner 16 as shown in FIG. 2. The variable phase device 18 can selectively assume a first state in which it couples the signal received by the antenna element 4 and transmitted through the feeder 14 to the input 16*b* of the combiner 16 without modifying it, and a second state in which it couples the said signal to the input 16*b* of the combiner 16, giving the signal a phase difference of 180° relative to a signal received by the antenna element 2 and transmitted through the transmission line 12. In the second state, the variable phase device 18 exhibits an amount of delay two times as large as the delay amount in the feeder 12. In the second state, the signal at the input 16*a* of the combiner 16 is a signal received by the antenna 2 and delayed by ΔL in the transmission line 12, and the signal at the input 16*b* of the combiner 16 is a signal received by the antenna 4 and delayed, relative to the signal received by the antenna 2 by an amount corresponding to the distance d and, further, by 2ΔL in the variable phase device 18. Accordingly, the phase difference between the two signals combined in the combiner 16 is ΔL+d, and, therefore, the radio wave coming from the front side is substantially cancelled out. Accordingly, the antenna 1 exhibits the backward directivity.

The variable phase device 18 has selecting means, for example, a selector switch 20 that has contacts 20*a* and 20*b*. The switch 20 also has a contact element 20*c* that is selectively brought into contact with the contacts 20*a* and 20*b*. The contact element 20*c* is connected to the feeder 14, and the contact 20*a* is connected to the input 16*b* of the combiner 16. Connected between the contacts 20*a* and 20*b* is a delay element, e.g. a delay line 22 having such a length as to provide a delay of 180° for the signal at the above-stated center frequency. With the contact 20*a* contacted by the contact element 20*c*, the signal transmitted through the feeder 14 is coupled to the input 16*b* of the combiner 16 without being delayed. With the contact 20*b* contacted by the contact element 20*c*, the signal transmitted through the feeder 14 has its phase inverted by the delay line 22 before being coupled to the input 16*b* of the combiner 16. The selector switch 20 may be an electronic selector switch, e.g. a semiconductor switching device. The semiconductor switching device may be, for example, a PIN diode. With an electronic selector switch, directivity switching can be remote controlled. The variable phase device 18 may be connected to the feeder 12 instead of the feeder 14. Further, the variable phase device 18 may be formed on the printed circuit board 6.

As described above, the antenna 1 exhibits directivity in selected one of the forward and backward directions, and can be small in size because it is formed on the printed circuit board 6.

Figure 6:
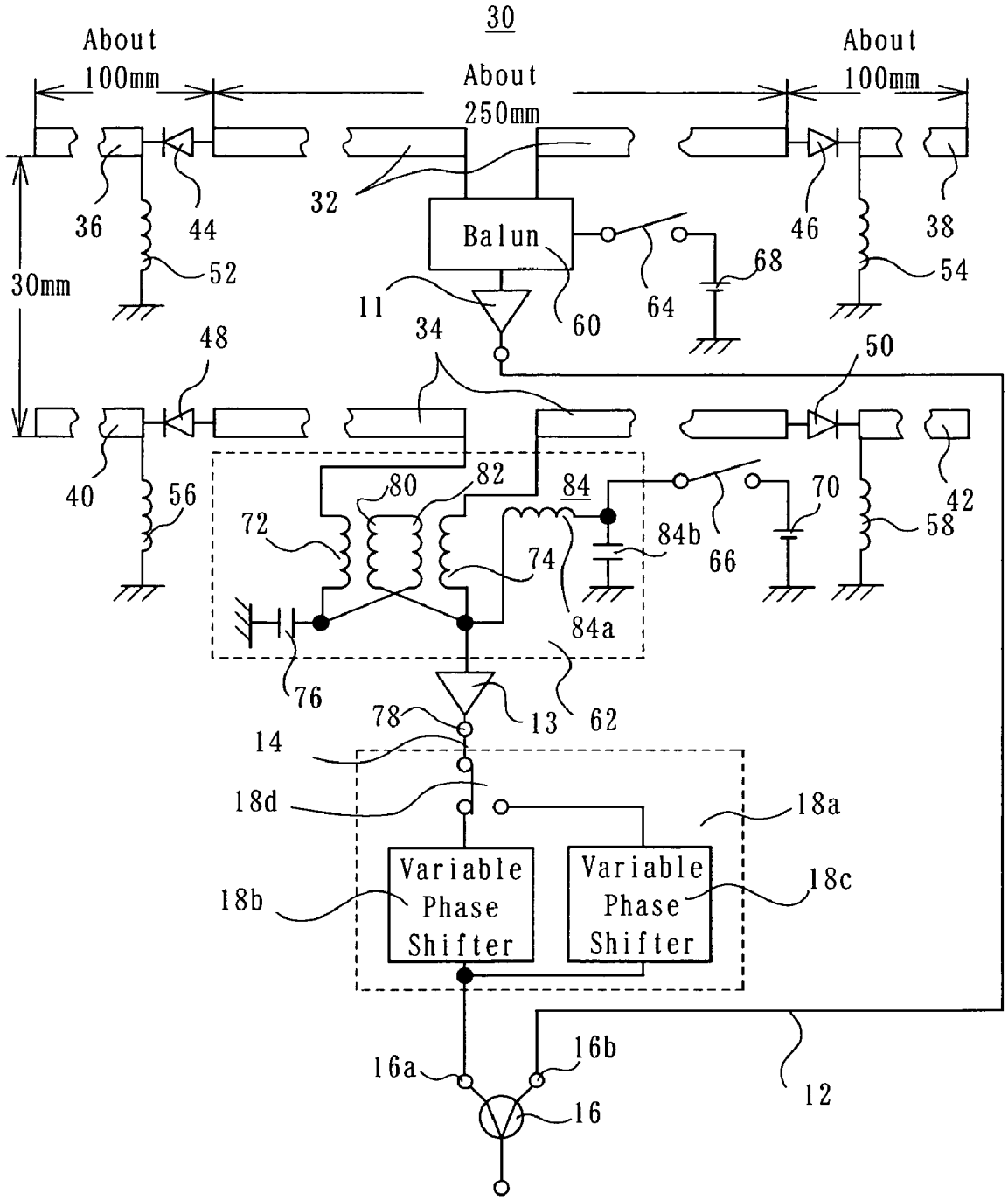
FIG. 6 schematically shows the arrangement of a variable directivity antenna according to a second embodiment of the present invention.
Figure 7:
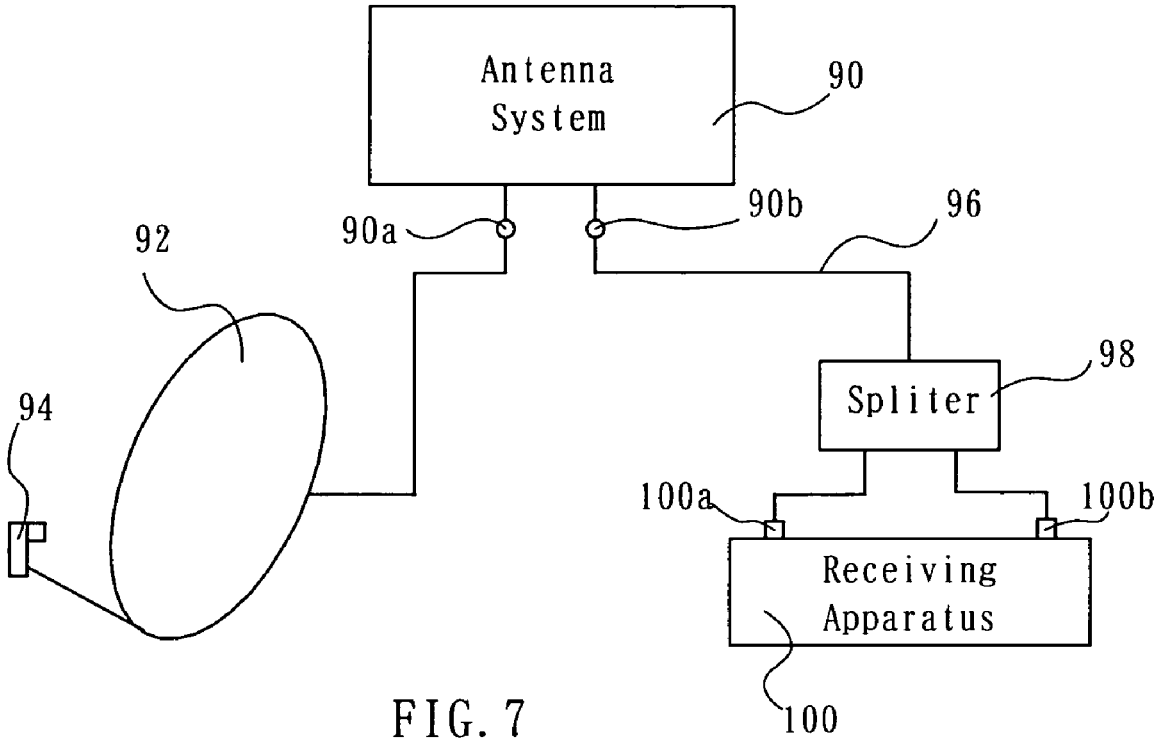
FIG. 7 is a block circuit diagram of a receiving system employing a variable directivity antenna system according to a third embodiment of the present invention.

The above-described antenna 1 is for receiving radio waves in the UHF band. An antenna 30 according to a second embodiment of the invention shown in FIG. 6 is arranged to be able to receive radio waves in a second frequency band, e.g. VHF television broadcasting waves (at frequencies of 54-88 MHz and 174-216 MHz), in addition to waves in the UHF band. In order for the antenna 30 to be operable both in the UHF and VHF bands, dipole antennas are used as antenna elements 32 and 34. The antenna elements 32 and 34 have a length of about 250 mm, and are disposed in parallel with each other. The antenna elements 32 and 34 are spaced by a distance d of about 30 mm. Like the antenna 1 of the first embodiment, the antenna elements 32 and 34 are formed on a printed circuit board.

Outward of and close to the respective opposite outer ends of the antenna element 32, extension elements 36 and 38 are disposed in line with the antenna element 32. Similarly, extension elements 40 and 42 are disposed in line with the antenna element 34 outward of and close to the respective opposite outer ends of the antenna element 34. The extension elements 36, 38, 40 and 42 are also formed on the printed circuit board by etching metal layers on the board. The length of each of the extension elements 36, 38, 40 and 42 is about 100 mm. Accordingly, the sum in length of the antenna element 32 and its extension elements 36 and 38 is about 450 mm, and the sum in length of the antenna element 34 and its extension elements 40 and 42 is also about 450 mm.

Switching means, which may be semiconductor switching devices, e.g. PIN diodes 44 and 46, are connected between the outer ends of the antenna element 32 and the extension elements 36 and 38, respectively. The PIN diodes 44 and 46 have their anodes connected to the antenna element 32 and have their cathodes connected respectively to the extension elements 36 and 38. Similarly, PIN diodes 48 and 50 are connected between the outer ends of the antenna element 34 and the extension elements 40 and 42, respectively. The PIN diodes 44 and 46 have their anodes connected to the antenna element 34 and have their cathodes connected respectively to the extension elements 40 and 42. With the PIN diodes 44, 46, 48 and 50 being conductive, the antenna element 32 is connected to the extension elements 36 and 38, and the antenna element 34 is connected to the extension elements 40 and 42, so that the antenna elements 32 and 34 with their extension elements can operate as VHF antennas. With the PIN diodes 44, 46, 48 and 50 rendered nonconductive, only the antenna elements 32 and 34 operate and act as UHF antennas.

In order to render the PIN diodes 44, 46, 48 and 50 conductive and nonconductive, the extension elements 36, 38, 40 and 42 are connected to a point of reference potential, e.g. a point of ground potential, via respective current supply paths, e.g. high-frequency blocking coils 52, 54, 56 and 58. In order to cause DC current to flow from the antenna element 32 through the PIN diodes 44 and 46 and the high-frequency blocking coils 52 and 54, a switch 64 and a DC supply 68 are connected to a balun 60 to which central feed points of the antenna element 32 are connected. Similarly, in order to cause DC current to flow from the antenna element 34 through the PIN diodes 48 and 50 and the high-frequency blocking coils 56 and 58, a switch 66 and a DC supply 70 are connected to a balun 62 to which central feed points of the antenna element 34 are connected. Instead of using the DC supplies 68 and 70 in association with the switches 64 and 66, respectively, a single DC supply may be connected to the switches 64 and 66.

The baluns 60 and 62 have the same configuration, and, therefore, only the balun 62 is described in detail. Respective one ends of inductors 72 and 74 are connected to the two feeding points of the antenna element 34. The other end of the inductor 72 is grounded via a capacitor 76, and the other end of the inductor 74 is connected to an output terminal 78 of the balun 62. An inductor 80 is disposed with respect to the inductor 72 in such a way that they are inductively coupled with each other, and an inductor 82 is disposed with respect to the inductor 74 in such a way that they are inductively coupled with each other. The inductors 80 and 82 have their one ends interconnected, with the other end of the inductor 80 connected to the other end of the inductor 74, and with the other end of the inductor 82 connected to the other end of the inductor 72. A series combination of the switch 66 and the DC supply 70 is connected via a low-pass filter 84 to the junction of the inductors 74 and 80. The low-pass filter 84 includes a high-frequency blocking coil 84*a* and a capacitor 84*b*.

With the switch 66 closed, current from the DC supply 70 flows through the inductor 74, the antenna element 34 and the PIN diode 50 to the high-frequency blocking coil 58, and also flows through the inductors 80, 82 and 72, the antenna element 34, and the PIN diode 48 to the high-frequency blocking diode 56. This renders the PIN diodes 48 and 50 conductive for receiving the UHF band. If the switch 66 is opened, no DC current flows from the DC supply 70, rendering the PIN diodes 48 and 50 nonconductive, for receiving the UHF band.

Similarly, by opening or closing the switch 64 associated with the balun 60, the UHF or VHF band reception mode can be selected. It is desirable to operate the switches 64 and 66 in synchronization with each other. By using semiconductor switching devices as the switches 64 and 66, and supplying external switching control signals to the switches 64 and 66, remote control is possible.

The remainder of the antenna 30 is similar to the antenna 1 of FIG. 1, the same reference numerals and symbols as used in FIG. 1 are used for the same or similar components, and their detailed description is not made. It should be noted, however, that a variable phase device 18*a* is used in place of the variable phase device 18. The variable phase device 18*a* includes two variable devices 18*b* and 18*c* for the reception of the VHF and UHF bands which are selectively used, being selected by a switch 18*d*. When the switches 64 and 66 are open, the variable phase device 18*b* for the UHF band is used, while the variable phase device 18*c* for the VHF band is used when the switches 64 and 66 are closed. By using a semiconductor switching device as the switch 18*d*, remote control of the variable phase device 18*a* is possible.

The above-described arrangement makes it possible to selectively receive radio waves in the UHF and VHF bands coming to the antenna 30 from the front and back thereof.

A variable directivity antenna system 90 according to a third embodiment of the invention is shown in FIGS. 7 through 11. The variable directivity antenna system 90 includes an antenna set formed of antennas 30*a* and 30*b* of the same configuration as the antenna 30 according to the second embodiment shown in FIG. 6. The antenna system 90 can receive well any desired one of UHF and VHF radio waves coming from various directions.

The antenna system 90 receives, at its input terminal 90*a*, a satellite broadcast intermediate-frequency signal resulting from a satellite broadcast signal received by a satellite broadcast receiving antenna, e.g. a satellite broadcast receiving parabolic antenna 92, and frequency-converting in a converter 94 provided in association with the parabolic antenna 92. The satellite broadcast intermediate-frequency signal is mixed with a UHF or VHF band television broadcast signal received by the antenna system 90, and the mixture signal is outputted from an output terminal 90*b* of the antenna system 90. The mixture signal at the output terminal 90*b* is coupled through a transmission line 96 to a splitter 98 where the mixture signal is split into the satellite broadcast intermediate-frequency signal and the VHF or UHF band television broadcast signal. The satellite broadcast intermediate-frequency signal is coupled to a satellite broadcast intermediate-frequency signal input terminal 100*a* of a receiving apparatus 100, and the VHF or UHF band television broadcast signal is coupled to a VHF/UHF band television broadcast signal input terminal 100*b*.

Figure 8:
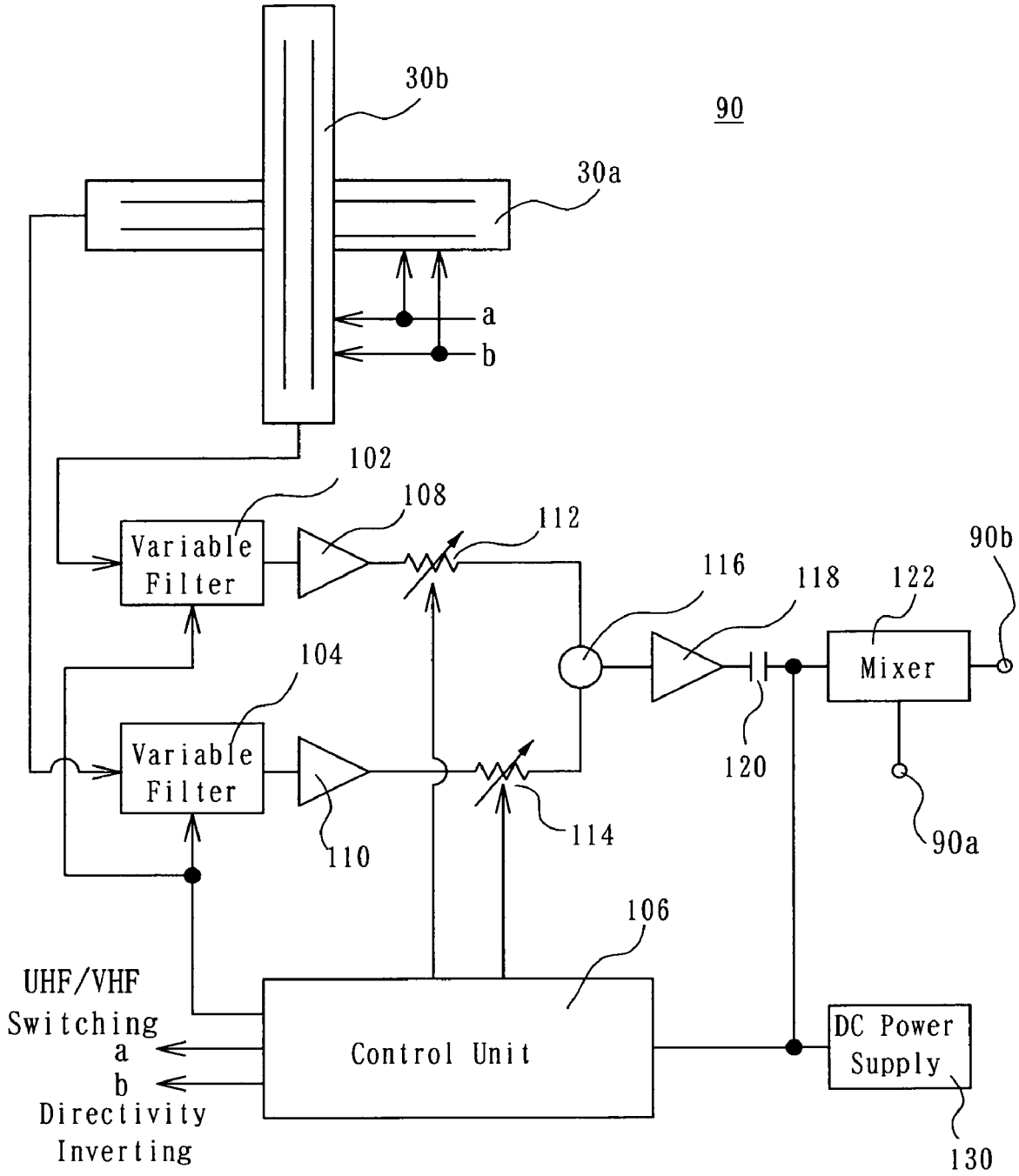
FIG. 8 is a block circuit diagram of the variable directivity antenna system of the third embodiment used in the receiving system of FIG. 7.

The antennas 30*a* and 30*b* of the antenna system 90 are disposed to orthogonally intersect with each other as shown in FIG. 8. The antennas 30*a* and 30*b* are formed on separate printed circuit boards by etching and are disposed at different levels so as to be orthogonal with each other at their feeding points. The antennas 30*a* and 30*b* may be formed on a single printed circuit board.

Signals from the antennas 30*a* and 30*b* are coupled to variable filter means, e.g. variable filters 102 and 104. The variable filters 102 and 104 are bandpass filters each having a passband variable to a desired one of the UHF band and the VHF band, for example, and the passband is varied in response to a passband varying signal supplied by passband varying control means, e.g. a control unit 106. The passbands are varied so that the frequencies of the radio waves to be received by the antenna system 90 can lie in the passbands. In place of the bandpass filters, variable cutoff frequency high-pass or low-pass filters may be used. The cutoff frequencies of such high-pass or low-pass filters are so varied that the frequencies of the waves to be received can be within the passbands of the filters.

Output signals of the variable filters 102 and 104 are amplified in amplifiers 108 and 110, respectively, and coupled to level adjusting means, e.g. variable attenuators 112 and 114, respectively. The variable attenuators 112 and 114 may include a semiconductor device, e.g. a PIN diode, having its conductivity varied in response to a respective level control signal supplied to it from level control signal generating means, which may be the control unit 106. Variable gain amplifiers may be used in place of the variable attenuators 112 and 114.

The output of the variable attenuator 112 is the output signal from the amplifier 108 multiplied by a factor K1, and the output of the variable attenuator 114 is the output signal from the amplifier 110 multiplied by a factor K2. The factor K1 is variable in response to the level control signal for the variable attenuator 112, and the factor K2 is variable in response to the level control signal for the variable attenuator 114. As shown in FIG. 9, the level control signal for the variable attenuator 112 varies the factor K1 from a first value, e.g. 1, through 0 to a second value, e.g. −1, which is equal in absolute value but has an opposite sign to the first value. The variation is in a cosine waveform fashion. The level control signal for the variable attenuator 114 varies the factor K2 from zero through the first value, e.g. 1, back to 0. The variation of the factor K2 is sinusoidal and in synchronization with the factor K1. Accordingly, the value of $K1^2+K2^2$ is always the first value, e.g. 1. The value of the sum, $K1^2+K2^2$, can be other than 1, as shown in FIG. 9, as long as the factors K1 and K2 change in the above-described synchronized, sine and cosine waveform fashions.

The control unit 106 provides the antennas 30*a* and 30*b* with frequency-band switching signals for switching the antenna 30*a* and 30*b* between the UHF receiving mode and the VHF receiving mode, i.e. selectively opening and closing the switches 64 and 66 shown in FIG. 6, and for switching the switch 18*d* of the variable phase device 18*a*. Also, the control unit 106 provides the antennas 30*a* and 30*b* with a directivity inverting signal for inverting the phase of signals by 180° in the variable phase devices 18*b* and 18*c*.

Output signals of the variable attenuators 112 and 114 are combined with each other in combining means, e.g. a combiner 116. Thus, the directivity of the combined signal of the antennas 30*a* and 30*b* as combined in the combiner 116 can be varied to any desired direction by changing the factors K1 and K2, as is well known. Let it be assumed that the phase shifters 18*b* and 18*c* are so adjusted to provide, for example, the antenna 30*a* with the upward directivity in the plane of the sheet of FIG. 8, and the antenna 30*b* with the leftward directivity. In this state, if the factor K1 for the variable attenuator 112 is 1 and the factor K2 for the variable attenuator 114 is 0, the directivity of the signal at the output of the combiner 116 is as shown in FIG. 10A. When the factor K1 is cos 30° with the factor K2 being sin 30°, the directivity rotates by 30° from the one shown in FIG. 10A to the one shown in FIG. 10B. With the factors K1 and K2 being cos 45° and sin 45°, respectively, the directivity rotates by 45° from the one shown in FIG. 10A to the one shown in FIG. 10C. With the factors K1 and K2 being cos 60° and sin 60°, respectively, the directivity rotates by 60° from the one shown in FIG. 10A to the one shown in FIG. 10D. With the factors K1 and K2 being cos 90° and sin 90°, respectively, the directivity rotates by 90° from the one shown in FIG. 10A to the one shown in FIG. 10E. Similarly, when the factor K1 is changed to cos 180° with the factor K2 changed to sin 180°, the directivity changes from the one shown in FIG. 10E to the one shown in FIG. 10F. By properly selecting the values of the factors K1 and K2, the directivity can be changed to any one lying between adjacent ones shown in FIGS. 10A-10F. To change the directivity from the one shown in FIG. 10F to any desired one between the directivities shown in FIGS. 10F and 10A, the variable phase devices 18*b* and 18*c* associated with the antennas 30*a* and 30*b* are adjusted to invert, by 180°, the directivities inherent to the antennas 30*a* and 30*b*, and, then, the factors K1 and K2 are changed in a manner similar to the one described above.

As described above, since the directivity of the antenna system 90 can be changed to any direction over 360°, it can receive well any desired one of radio waves from various directions. The control unit 106 controls the passbands of the variable filters 102 and 104 to pass therethrough the desired radio wave when it is being received by the antenna system 90, whereby the antenna system 90 is prevented from receiving undesired radio waves, which can improve a D/U ratio.

An output signal from the combiner 116 is amplified by an amplifier 118 and, then, coupled through a DC blocking capacitor 120 to a mixer 122. The mixer 122 receives also the satellite broadcast intermediate-frequency signal from the input terminal 90*a* of the antenna system 90. The output signal of the combiner 116 and the satellite broadcast intermediate-frequency signal are mixed with each other in the mixer 122, and the mixture signal developed at the output terminal 90*b* of the antenna system 90 is coupled via the transmission line 96 to the splitter 98 where the output signal of the mixer 116 and the satellite broadcast intermediate-frequency signal are separated for application to the satellite broadcast intermediate-frequency signal input terminal 100*a* of the receiving apparatus 100, and to the television broadcast signal input terminal 100*b*, as described previously.

Figure 11:
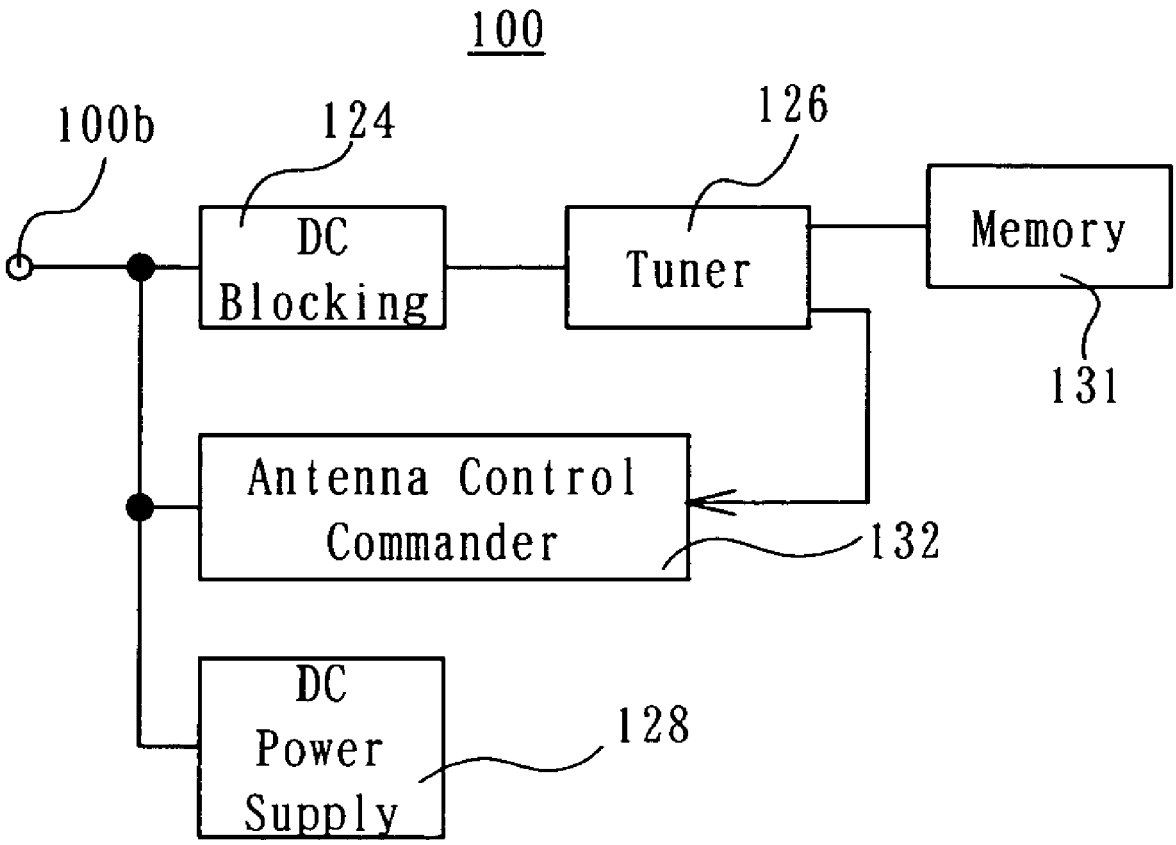
FIG. 11 is a block diagram of a receiving apparatus in the receiving system of FIG. 7.

A television broadcast signal processing unit of the receiving apparatus 100 includes, as shown in FIG. 11, a tuner 126 to which the television broadcast signal, i.e. the output signal of the mixer 116, is coupled through a DC blocking block 124, and the tuner 126 demodulates the received television broadcast signal. The receiver 100 includes a power supply unit, e.g. a DC power supply unit 128, for driving the antenna system 90. A DC voltage from the DC power supply unit 128 is coupled through the input terminal 100*b*, the splitter 98, the transmission line 96, the output terminal 90*b* of the antenna system 90, and the mixer 122 to a DC power supply unit 130 (FIG. 8). The DC power supply unit 130 regulates the voltage for application to various sections. The DC power supply unit 130 supplies DC power to the PIN diodes of the antenna 30*a* and 30*b*.

The receiving apparatus 100 includes also memory means, e.g. a memory 131. The memory 131 stores therein antenna control data necessary for the antenna system 90 to receive desired radio waves (e.g. a television broadcast channel desired to be received). Such control data is stored, being correlated with corresponding channel data indicative of respective desired television broadcast channels, and indicates the receiving band to be received, i.e. the UHF or VHF band, the desired direction of directivity, the passbands of the variable bandpass filters, and the phase conditions of the variable phase devices 18*b* and 18*c*. When the tuner 126 reads out channel data from the memory 131, the associated antenna control data is supplied to an antenna control commander 132. The antenna control commander 132 converts the antenna control data to an FSK signal or an ASK signal. The resulting FSK or ASK signal is applied to the control unit 106 through the input terminal 100*b*, the splitter 98, the transmission line 96, the output terminal 90*b* of the antenna system 90, and the mixer 122. When receiving the FSK or ASK signal, the control unit 106 demodulates the FSK or ASK signal to the antenna control data. In accordance with the demodulated antenna control data, the switches 66 and 68 of the antennas 30*a* and 30*b* are ON-OFF controlled, the passbands of the variable filters 102 and 104 are modified, and the factors K1 and K2 for the variable attenuators 112 and 114 are altered, and the variable phase devices 18*b* and 18*c* of the antennas 30*a* and 30*b* are set to provide in-phase or 180°-out-of-phase condition.

Figure 12:
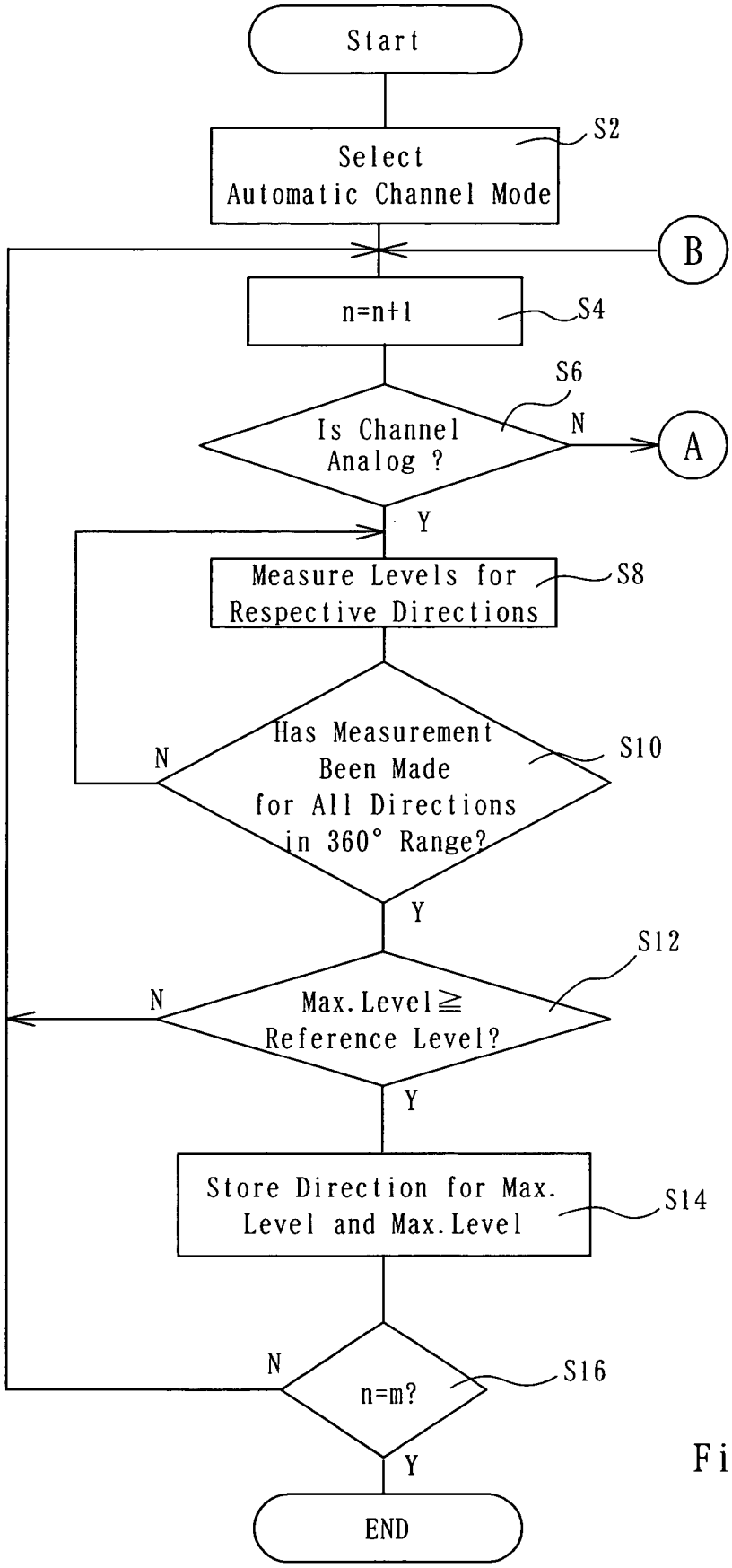
FIG. 12 shows part of a flow chart for use in explaining how antenna directivities are stored in a memory in a tuner of the receiving apparatus of FIG. 11.
Figure 13:
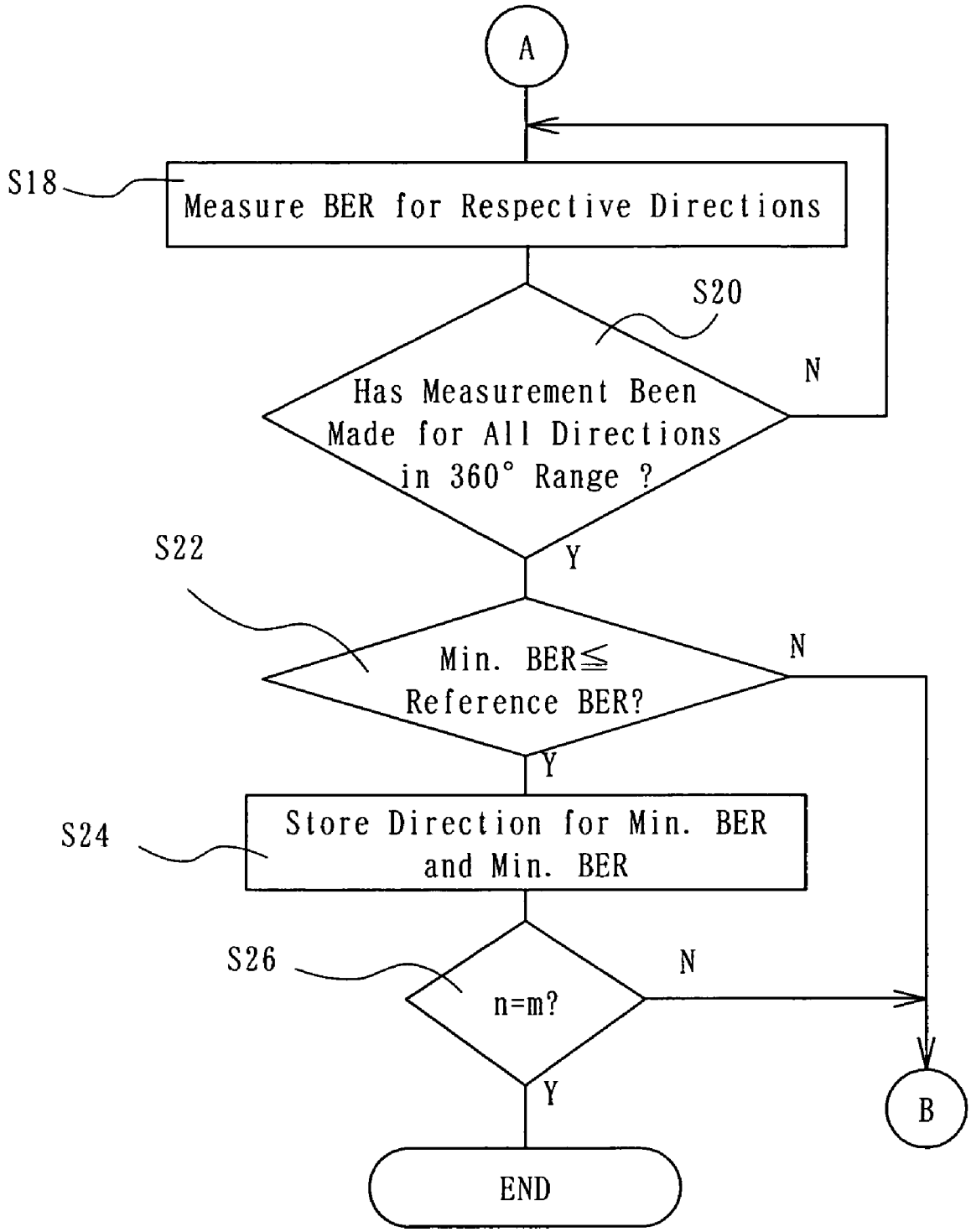
FIG. 13 shows the remainder of the flow chart for use in explaining how antenna directivities are stored in a memory in a tuner of the receiving apparatus of FIG. 11.

In order for such control to be provided, it is necessary to store the receiving channel data and the corresponding antenna control data in association with each other, in the memory 131. For that purpose, the processing as shown in FIGS. 12 and 13 is performed in the tuner 126. The tuner 126 can receive both analog television broadcast signals and digital television broadcast signals.

First, an automatic channel mode is selected (Step S2). This causes the channel designating value in a channel counter n to be set to an initial value. The channel counter n is for designating a channel to be received. Then, the value in the channel counter n is increased by one for designating a certain channel to be received (Step S4), whereby this channel is selected in the tuner 126, and, at the same time, data for making the variable filters 102 and 104 have passbands for receiving that channel is transmitted from the antenna control commander 132 to the control unit 106. Then, the tuner 126 makes a judgment as to whether the selected channel is an analog_television broadcast channel or not (Step S6).

If the selected channel is an analog television broadcast channel, a command is transmitted from the antenna control commander 132 to the control unit 106 to successively change K1 and K2 and also to adjust the variable phase devices 18*b* and 18*c* to provide the in-phase or 180°-out-of-phase condition, whereby the direction of directivity of the antenna is successively changed. The reception level for each direction is measured in the tuner 126 and stored (Step S8). In Step S10, whether the directivity of the antenna has been measured for all the predetermined directions in the angular range of 360° or not is judged. If it has not, the execution of Steps S8 and S10 is repeated in loop until the answer to the query in Step S10 becomes YES. When the answer to the query in Step S10 becomes YES, whether or not the largest one of the measured levels is at or above a predetermined reference level is examined (Step S12). In other words, whether or not there is directivity providing an acceptable receiving condition is judged. If the answer is YES, the direction of directivity providing the largest reception level is stored together with the largest reception level in the memory 131 (Step S14). At the same time, the data representing the passbands of the variable filters 102 and 104, and the data indicating which condition, in-phase or 180°-out-of-phase condition, the variable phase devices 18*b* and 18*c* provided, employed when the largest reception level has been attained, are stored in the memory 131 in association with the largest directivity providing direction and the largest reception level. After that, whether the value in the channel counter n is the value for the last one of the receiving channels is judged (Step S16). If the answer is NO, it means that there are channels left for which the direction of directivity has not yet been determined. Then, the processing is repeated from Step S4 until the answer to the query in Step S16 becomes YES.

The answer of NO to the query in Step S12 indicates that there is a possibility that no radio wave is broadcast in that channel. In this case, Step S4 is executed to designate the next receiving channel.

If the selected channel is judged to be a digital television broadcast channel in Step S6, the direction of directivity of the antenna system 90 is varied, and the bit error rate (BER) for each direction is measured and stored (Step S18), as shown in FIG. 13. Then, whether the bit error rate has been measured and stored for all of the predetermined directions in the angular range of 360° is judged (Step S20). If the measurement and storage has not been completed, Steps S18 and S20 are repeated in loop until the answer in Step S20 changes to YES. When the answer to the query in Step S20 changes to YES, whether the smallest one of the measured bit error rates is equal to or smaller than a predetermined rate is judged (Step S22). That the smallest bit error rate is not greater than the predetermined rate means that the digital television broadcast signal can be received by the antenna system 90 with an allowable level, that direction of the antenna directivity and the smallest bit error rate are stored in the memory 131 (Step S24). At the same time, the data specifying the passbands of the_variable filters 102 and 104, and the data indicating which condition, in-phase or 180°-out-of-phase condition, the variable phase devices 18*b* and 18*c* provide, employed when the allowable smallest bit error rate has been attained, are stored in the memory 131 in association with the direction of the antenna directivity in which the smallest bit error rate is measured and that smallest bit error rate. Thereafter, whether the value in the channel counter n is the value corresponding to the largest channel is seen (Step S26), and if the value is not for the largest channel, the steps are repeated from Step S4, as indicated.

The answer of NO to the query in Step S22 may mean that no wave is broadcast in that channel, and, therefore, the processing is repeated from Step S4.

In this way, the storing in the memory 131 of the antenna control data necessary for the antenna system 90 to receive desired radio waves is completed.

It may occur that, while a radio wave of a certain television channel is being received by the tuner 126, a broadcast signal condition worsens to an unacceptable condition. In such a case, processing as shown in FIGS. 14 and 15 is executed for that television channel.

Figure 14:
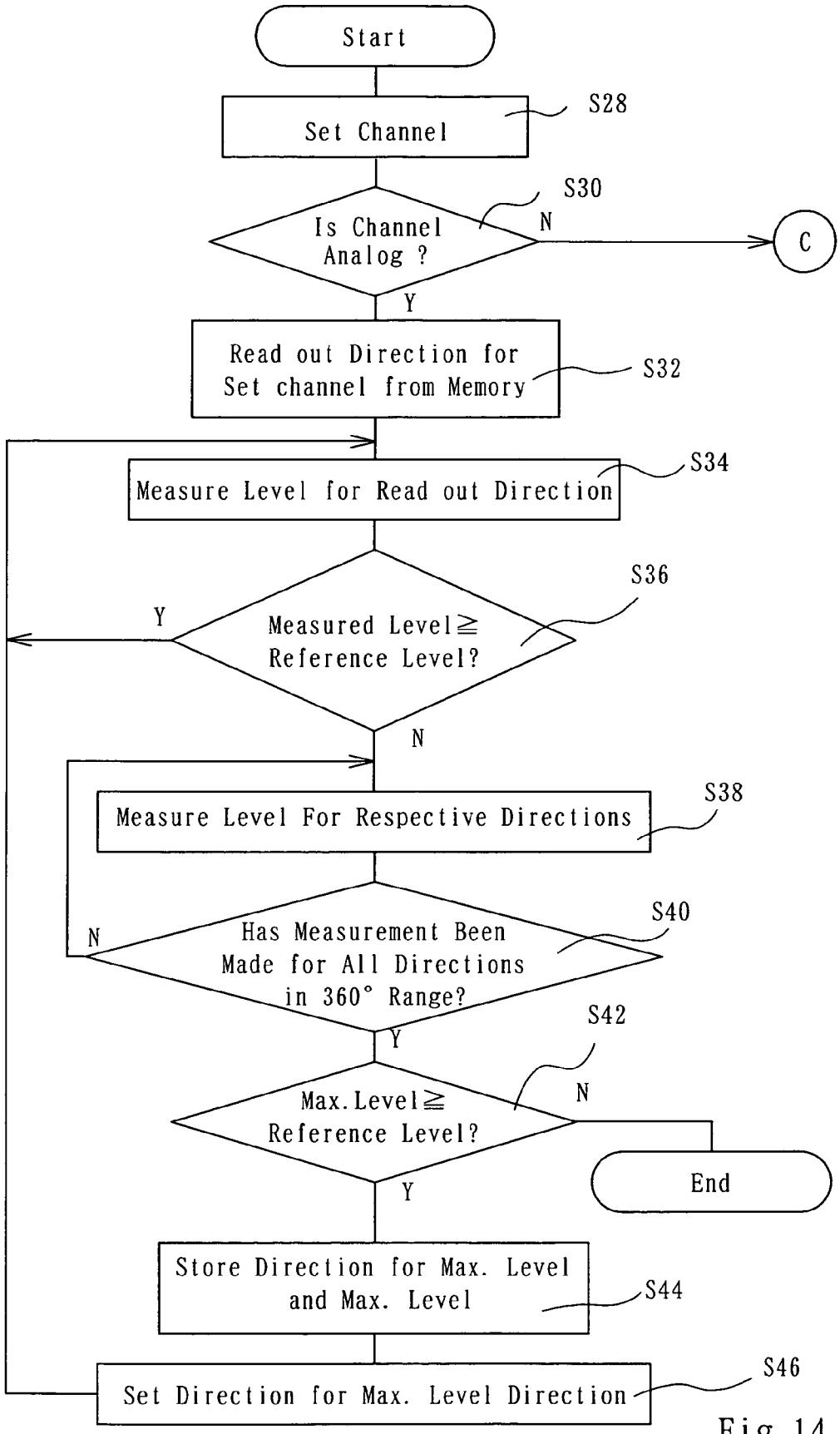
FIG. 14 shows part of a flow chart for use in explaining the processing performed in the tuner of the receiving apparatus of FIG. 11 when the antenna directivity deviates from an acceptable state.
Figure 15:
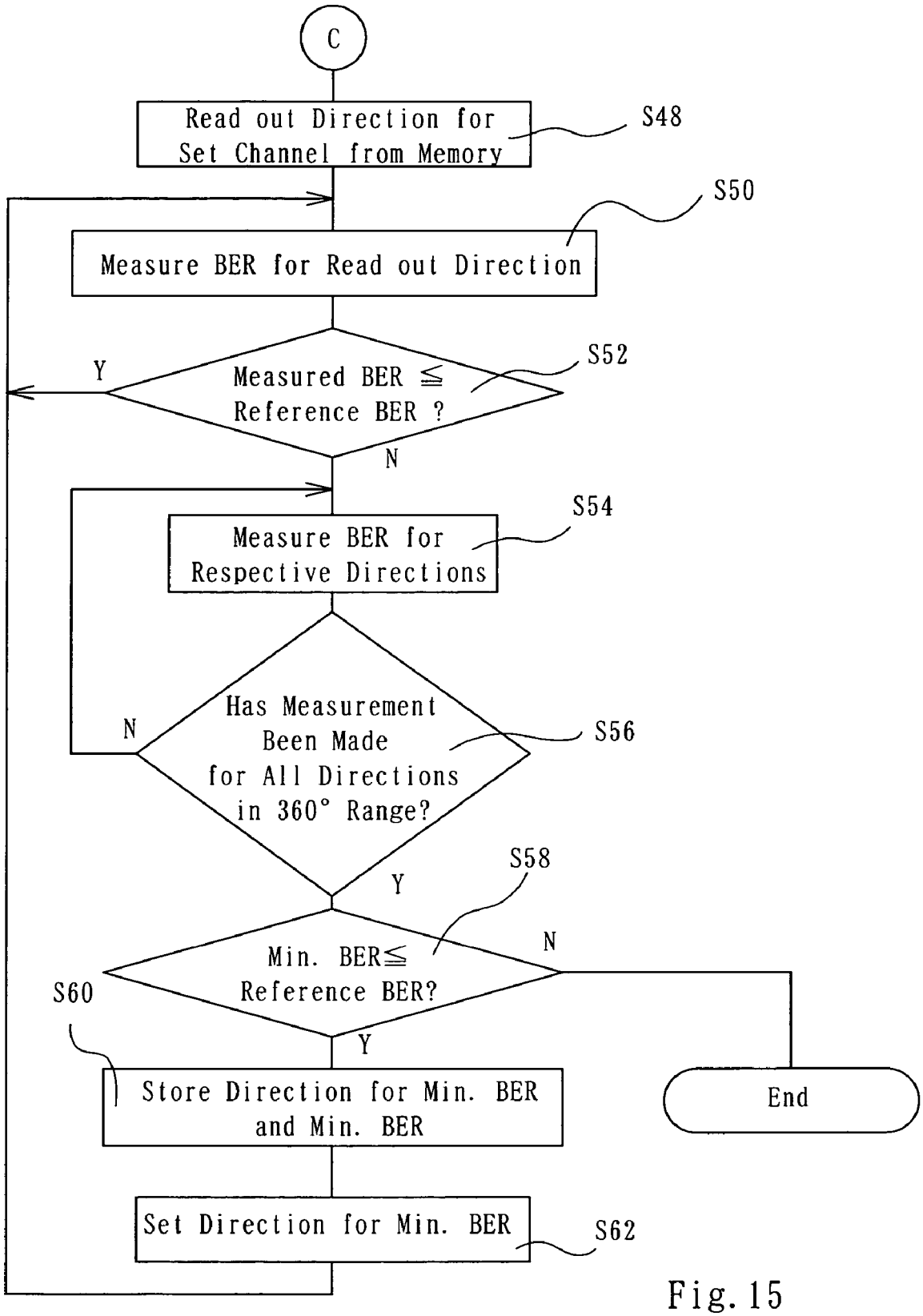
FIG. 15 shows the remainder of the flow chart for use in_explaining the processing performed in the tuner of the receiving apparatus of FIG. 11 when the antenna directivity deviates from an acceptable state.

Referring to FIG. 14, a desired channel to be received is selected and set (Step S28). Whether the desired channel is an analog television broadcast channel or a digital television broadcast channel is judged (Step S30). If the selected channel is an analog channel, the antenna control data relating to the direction of directivity for the desired channel is read out from the memory 131 and set (Step S32). Then, the reception signal level for the set directivity is measured (Step S34). The measured level is examined as to if it is equal to or higher than the reference level (Step S36). If the level is at or above the reference level, which means that the signal is being received in a good condition, the reception of the radio wave of the channel is continued, repeating Steps S34 and 36 in loop.

If it is judged, in Step S36, that the received signal level is lower than the reference level, the direction of antenna directivity is successively altered, and the signal level at each of the altered directions is measured and stored (Step S38). Then, whether the signal levels for all the predetermined directions in the 360° angular range have been measured and stored is judged (Step S40), and, if not, Steps S38 and S40 are repeated in loop until the answer to Step S40 becomes YES. When it is judged, in Step S40, that the signal levels at all of the predetermined directions have been measured and stored, the highest one of the measured signal levels is examined as to if it is equal to or above the reference level (Step S42). If the answer is YES, the direction in which the highest level is obtained and the reception level are stored in the memory 131 (Step S44). Then, the antenna directivity is set for that direction (Step S46), and the processing resumes from Step S34.

The answer of NO to the query in Step S42 may mean that the signal in the channel cannot be received in an allowable condition with any directivities or the signal has disappeared. Accordingly, the reception of the signal in that channel is abandoned.

If the desired signal to be received is judged to be a digital television broadcast channel signal in Step S30, the processing shown in FIG. 15 is executed. The antenna system is set for the antenna directivity for the channel set in Step S28, using the data read out from the memory 131 (Step S48). Then, the BER (bit error rate) for that directivity is measured (Step S50). Whether the measured BER is not greater than the reference value is examined (Step S52). The fact that the measured BER is equal to smaller than the reference value means that the signal of the set digital broadcast channel is being received at an allowable level, the reception is continued, and the execution of Steps S50 and S52 is iterated. If the answer to the query in Step S52 becomes NO, the antenna_directivity is successively changed stepwise over a 360° angular range, and the BER for each directivity is stored (Step S54). Whether the antenna directivity has rotated 360° or not is judged (Step S56), and, if the answer is NO, the execution of Steps S54 and S56 is iterated until the answer changes to YES. When the answer to the query in Step S56 changes to YES, whether the smallest one of the stored values of BER is not greater than the reference BER value is examined (Step S58). If the answer is YES, the direction or directivity for which that smallest BER is obtained is stored together with that BER in the memory 131 (Step S60). The antenna directivity is adjusted to the stored direction (Step S62), and the processing is repeated from Step S50 again, The answer of NO to the query in Step S58 may mean that the signal in the channel cannot be received in an allowable condition with any directivities or the signal has disappeared. Accordingly, the reception of the signal in that channel is abandoned.

Figure 16:
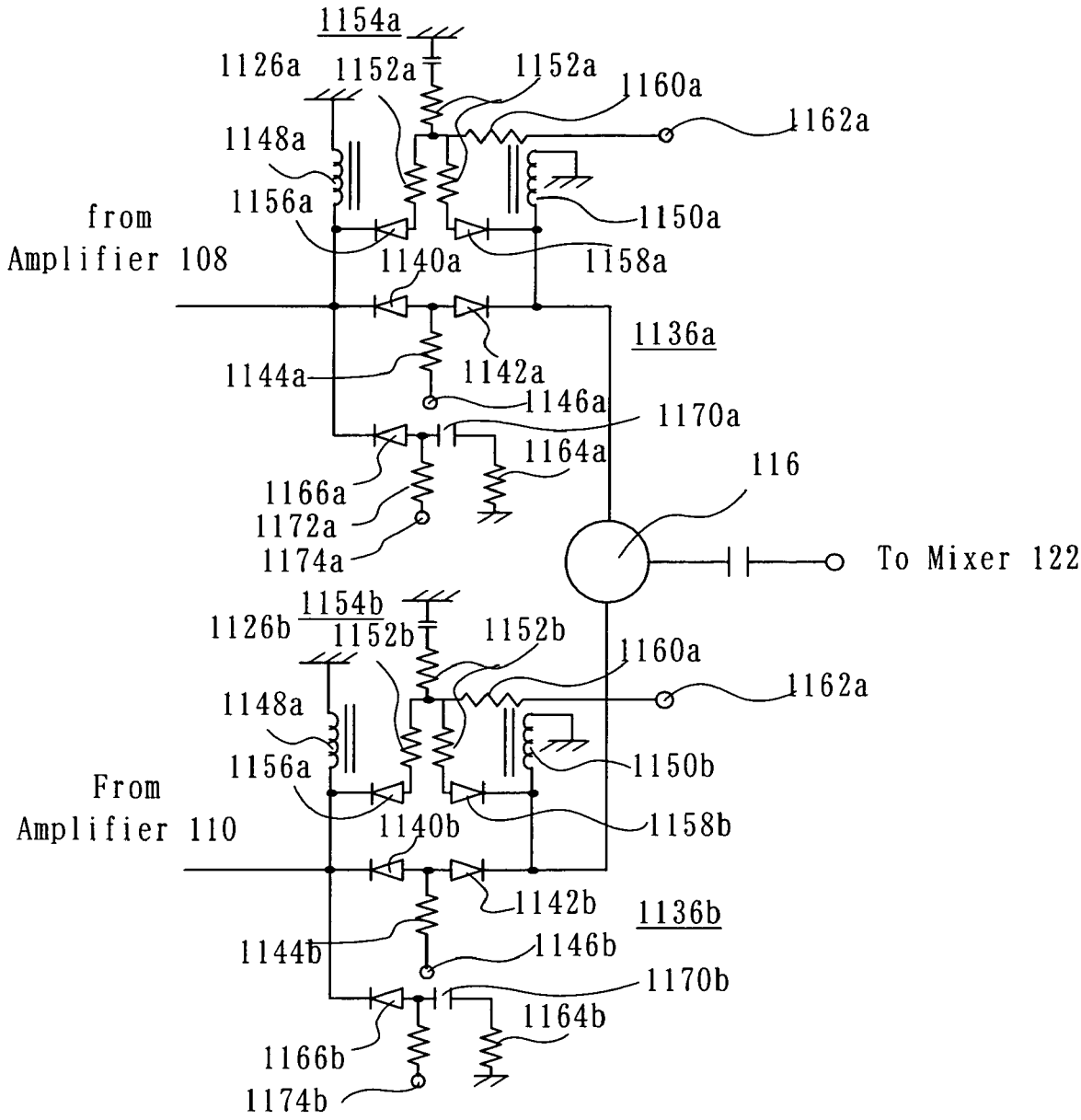
FIG. 16 is a circuit diagram of a level adjuster used in a variable directivity antenna system according to a fourth embodiment of the present invention.

A variable directivity antenna according to a fourth embodiment differs from the variable directivity antenna according to the third embodiment in the arrangement of the level adjusting means as shown in FIG. 16. The level adjusting means is formed of variable attenuators 1136*a* and 1136*b*, for example. The variable attenuators 1136*a* and 1136*b* have their attenuation amounts adjustable to any selected one of three attenuation amounts, 0 dB, 7 dB and ∞, for example. By appropriately combining the adjustment of the attenuation amounts provided by the variable attenuators 1136*a* and 1136*b* and the adjustment of the directivities of the antennas 30*a* and 30*b* through the variable phase device 18*a*, the directivity can be adjusted in sixteen steps in total at predetermined angular intervals of, for example, 22.5°, in the clockwise direction from the forward direction at 0°.

For that purpose, the variable attenuator 1136*a* has switching elements, e.g. PIN diodes 1140*a* and 1142*a* connected in series between the amplifier 108 and the combiner 116. The PIN diode 1140*a* has its cathode connected to the output of the amplifier 108, the anodes of the PIN diodes 1140*a* and 1142*a* are connected together, and the cathode of the PIN diode 1142*a* is connected to the input of the combiner 116. The anodes of the PIN diodes 1140*a* and 1142*a* are connected through a resistor 1144*a* to a voltage supply unit 1146*a*, and the cathodes of the PIN diodes 1140*a* and 1142*a* are connected through high frequency blocking coils 1148*a* and 1150*a*, respectively, to a point of reference potential. Accordingly, when a positive voltage is coupled to the voltage supply unit 1146*a*, the PIN diodes 1140*a* and 1142*a* are rendered conductive, so that the signal from the amplifier 108 is coupled to the combiner 116 without being attenuated.

The variable attenuator 1136*a* has a fixed attenuator, e.g. a T-type attenuator 1154*a*. The attenuator 1154*a* is comprised of three resistors 1152*a* and provides attenuation of 7 dB. A switching element is connected to the input of the attenuator 1154*a*. For example, a PIN diode 1156*a* has its anode connected to the input of the attenuator 1154*a*, and has its cathode connected to the cathode of the PIN diode

1140*a*. Similarly, a switching element, e.g. a PIN diode 1158*a* has its anode connected to the output of the attenuator 1154*a*, and has its cathode connected to the cathode of the PIN diode 1142*a*. The junction of the three resistors of the T-type attenuator 1154*a* is connected through a resistor 1160*a* to a voltage supply unit 1162*a*. Accordingly, when a positive voltage is coupled to the voltage supply unit 1162*a*, the PIN diodes 1156*a* and 1158*a* are rendered conductive, so that the T-type attenuator 1154*a* is coupled between the amplifier 108 and the combiner 116, and, therefore, the signal from the amplifier 108 is attenuated by 7 dB.

Further, the variable attenuator 1136*a* has a matching resistor 1164*a* having an impedance equal to the impedance of the antenna 30*a*. The matching resistor 1164*a* has its one end connected to a point of reference potential, and has the other end connected through a DC blocking capacitor 1170*a* to a switching element, e.g. a PIN diode 1166*a* at its anode. The PIN diode 1166*a* has its cathode connected to the cathode of the PIN diode 1140*a*, and has its anode connected through a resistor 1172*a* to a voltage supply unit 1174*a*. Accordingly, when a positive voltage is coupled to the voltage supply unit 1174*a*, the PIN diode 1166*a* is rendered conductive, so that the output of the amplifier 108 is connected through the matching resistor 1164*a* to a point of reference potential, which results in infinite attenuation.

Since the arrangement of the variable attenuator 1136*b* is similar to the variable attenuator 1136*a*, a suffix "b" is substituted for the suffix "a" attached to the reference numerals for the components equivalent to the ones of the attenuator 1136*a*, and no description is made.

To attain a variable directivity described above in the multiple frequency band antenna, for the azimuth of from 0 degrees to 67.5 degrees, the antenna 30*a* is made to exhibit the forward directivity, with the antenna 30*b* made to exhibit the rightward directivity. For the azimuth of from 90 degrees to 157.5 degrees, the antenna 30*a* is made to exhibit the backward directivity, while the antenna 30*b* is made to exhibit the rightward directivity. For the azimuth angle of from 180 degrees to 247.5 degrees, the antenna 30*a* is made to exhibit the backward directivity, while the antenna 30*b* is made to exhibits the leftward directivity. For the azimuth angle of from 270 degrees to 387.5 degrees, the antenna 30*a* is made to exhibit the forward directivity, while the antenna 30*b* is made to exhibit the leftward directivity.

For the azimuth of from 0 degrees to 45 degrees, the variable attenuator 1154*a* provides zero (0) attenuation, but its attenuation increases from 7 dB to infinity (∞) for the angle of from 67.5 degrees to 90 degrees. The amount of attenuation decreases from 7 dB to zero (0) for the angle of from 112.5 degrees to 135 degrees, and remains zero (0) for the angle of from 157.5 degrees to 225 degrees. For the angle of from 247.5 degrees to 270 degrees, the amount of attenuation increases from 7 dB to infinity (∞), decreases from 7 dB to zero (0) for the angle of from 292.5 degrees to 315 degrees, and is zero (0) for the angle of 337.5 degrees.

As for the variable attenuator 1154*b*, the amount of attenuation decreases from infinity (∞) to 7 dB and to zero (0) for the azimuth angle of from 0 degrees to 45 degrees, and remains zero (0) for the angle of 67.5 degrees to 135 degrees. For the azimuth angle of from 157.5 degrees to 180 degrees, the amount of attenuation increases from 7 dB to infinity (∞). The amount of attenuation given by the variable attenuator 1154*b* decreases from 7 dB to zero (0) for the angle of from 202.5 degrees to 225 degrees, remains zero (0) for the angle of from 247.5 degrees to 315 degrees, and is 7 dB for 337.5 degrees. Like this, when the amount of attenuation of one attenuator is zero (0), the amount of attenuation of the other increases or decreases.

The variable attenuators 1154*a* and 1154*b* of this embodiment employ 7 dB as one of the variable amounts of attenuation. The reason why the value of 7 dB is employed is that the half-width of the combined directivity of the antenna system 90 is from 75 degrees to 80 degrees. If the half-width of the combined directivity of the antenna system 90 is different from the value of from 75 degrees to 80 degrees, an amount of attenuation other than 7 dB is employed. For example, if the half-width of the combined directivity of the antenna system 90 is wider than the range of 75 degrees to 80 degrees, the amount of attenuation employed is larger than 7 dB. If the half-width of the combined directivity of the antenna system 90 is narrower than the range of 75 degrees to 80 degrees, the amount of attenuation employed is smaller than 7 dB.

Figure 17:
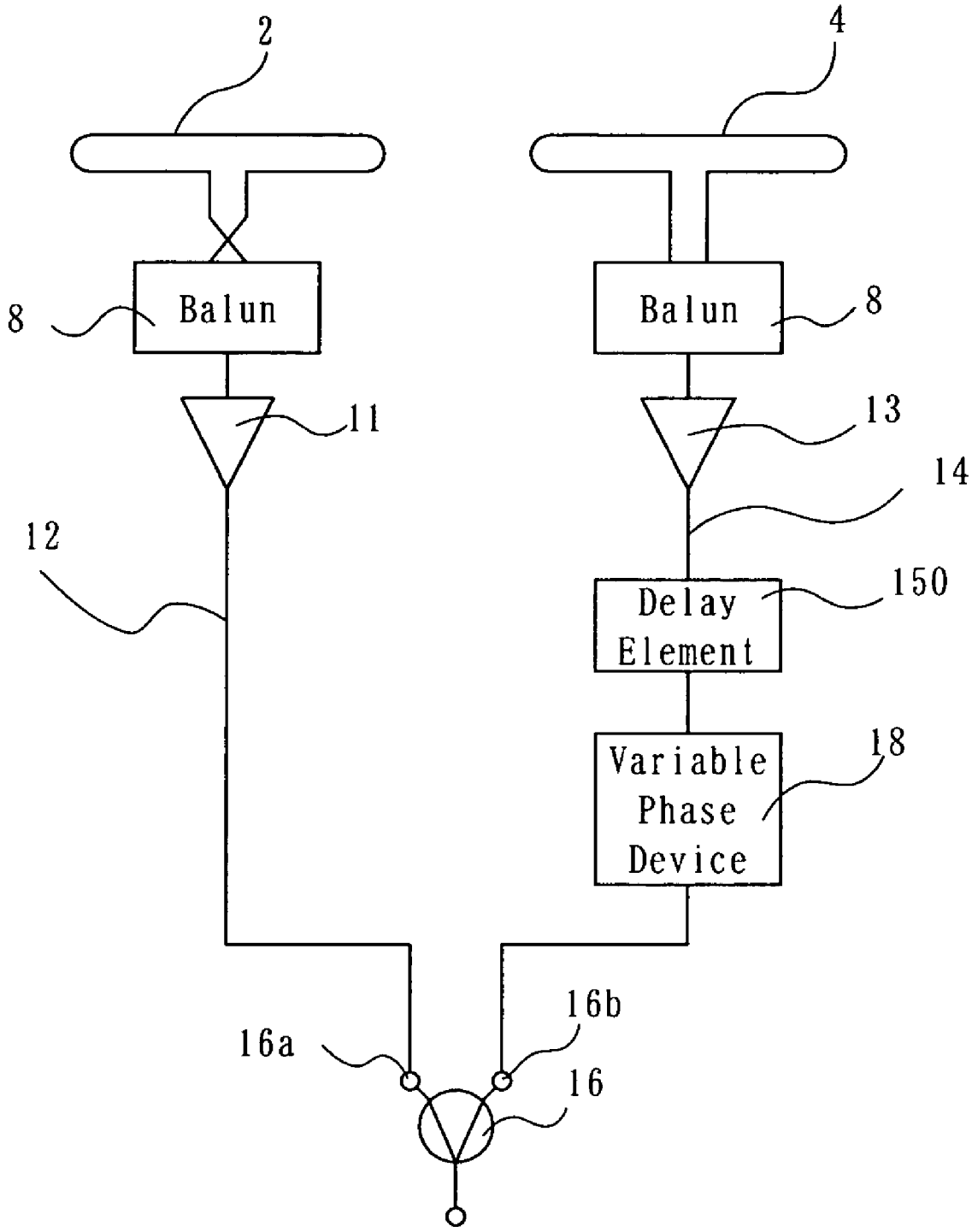
FIG. 17 is a block diagram of a modification of the antenna shown in FIG. 1.

The antenna 1 shown in FIG. 1 is arranged such that the received signals from the antenna elements 2 and 4 are coupled in phase with each other to the baluns 8 and 10, that the length of the feeder 12 is longer by ΔL than the feeder 14 to provide a delay, and that the variable phase device 18 is used. Alternatively, as shown in FIG. 17, the received signal from the antenna element 2 may be coupled to the balun 8 with a phase opposite to the phase of the received signal coupled from the antenna element 4 to the balun 10, with the feeder 14 longer by ΔL than the feeder 12 used to provide a delay as represented by a delay element 150 to the feeder 14, and with the variable phase device 18 connected in the succeeding stage of the delay element 150. The same modification may be done to the variable directivity antenna according to the second embodiment shown in FIG. 6.

In the antenna 1 shown in FIG. 1, the portions of the antenna elements 2 and 4 where the feeding points 2*a*, 2*b* and 4*a*, 4*b* are disposed are upper portions of the antenna elements 2 and 4 in FIG. 1. In other words, the antenna elements 2 and 4 are not disposed in line symmetry with respect to an imaginary axis of symmetry extending along the length direction of the printed circuit board 6. However, the antenna elements 2 and 4 can be disposed in line symmetry relative to the imaginary axis of symmetry. For example, while maintaining the position of the antenna element 4 as it is shown in FIG. 1, the antenna element 2 may be disposed in such a manner that the portion of the antenna element 2 where the feeding points 2*a* and 2*b* are provided can be downward in FIG. 1. Alternatively, while maintaining the position of the antenna element 2 as it is shown in FIG. 1, the antenna element 4 may be disposed in such a manner that the portion of the antenna element 4 where the feeding points 4*a* and 4*b* are provided is downward in FIG. 1.

The antenna system according to the third embodiment uses two antennas 30*a* and 30*b*, but the number is not limited to two, and a larger number of antennas may be used. Furthermore, instead of using dipole antennas as the antennas 30*a* and 30*b*, folded dipole antennas as used in the antenna 1 shown in FIG. 1 may be employed.

What is claimed is:

1. A variable directivity antenna comprising:

a first antenna group including first and second antennas for receiving a radio wave in a first frequency band, said first and second antennas being disposed in parallel with and spaced from each other by a distance less than a half of a wavelength in said first frequency band, said first and second antennas exhibiting an 8-shaped directivity along a line perpendicular to the length direction thereof; and phase shifting means for adjusting phases of received signals from said first and second antennas and combining the phase-adjusted signals in such a manner that the resultant signal selectively assumes a first directivity state in which said resultant signal exhibits a directivity in a first direction which is from said first antenna toward said second antenna, and a second directivity state in which said resultant signal exhibits a directivity in a second direction which is from said second antenna toward said first antenna, wherein said phase shifting means comprises:

combining means to which the received signals from said first and second antennas are supplied;

a first fixed phase shifter disposed between said combining means and said first antenna; and variable phase shifting means disposed between said second antenna and said combining means;

said variable phase shifting means, in said first directivity state, coupling the received signal from said second antenna as it is to said combining means, and, in said second directivity state, coupling a second fixed phase shifter between said second antenna and said combining means;

said first fixed phase shifter providing such an amount of phase shift that, in said first directivity state, signals coming from said second direction received by said first and second antennas are substantially in opposite phase, said second fixed phase shifter providing such an amount of phase shift that, in said second directivity state, a received signal from said second antenna is substantially in opposite phase with an output signal of said first fixed phase shifter.

2. The variable directivity antenna according to claim 1 wherein received signals from said first and second antennas are supplied to said phase shifting means after being amplified in first and second amplifiers.

3. The variable directivity antenna according to claim 1 wherein said first and second antennas are formed on a single printed circuit board.

4. A variable directivity antenna comprising:

a first antenna group including first and second antennas for receiving a radio wave in a first frequency band, said first and second antennas being disposed in parallel with and spaced from each other by a distance less than a half of a wavelength in said first frequency band, said first and second antennas exhibiting an 8-shaped directivity along a line perpendicular to the length direction thereof; and phase shifting means for adjusting phases of received signals from said first and second antennas and combining the phase-adjusted signals in such a manner that the resultant signal selectively assumes a first directivity state in which said resultant signal exhibits a directivity in a first direction which is from said first antenna toward said second antenna, and a second directivity state in which said resultant signal exhibits a directivity in a second direction which is from said second antenna toward said first antenna;

wherein said first and second antennas are first and second dipole antennas, respectively, having their entire lengths so selected as to receive a radio wave in said first frequency band; extension elements are disposed in line with and outward of opposite ends of each said dipole antennas; the sum of the lengths of said first dipole antenna and said extension elements disposed outward of said first dipole antenna is such as to receive a radio wave in a second frequency band lower than said first frequency band, the sum of the lengths of said second dipole antenna and said extension elements disposed outward of said second dipole being such as to receive a radio wave in said second frequency band; and switch means are connected between said first dipole antenna and said extension elements disposed outward of said first dipole antenna, and between said second dipole antenna and said extension elements disposed outward of said second dipole antenna.

5. A variable directivity antenna comprising:

a first antenna group including first and second antennas for receiving a radio wave in a first frequency band, said first and second antennas being disposed in parallel and spaced by a distance less than a half of a wavelength in said first frequency band, said first and second antennas exhibiting an 8-shaped directivity along a line perpendicular to the length direction thereof;

a second antenna group including third and fourth antennas for receiving a radio wave in said first frequency band, said third and fourth antennas being disposed in parallel with and spaced by said distance from each other, and exhibiting an 8-shaped directivity along a line perpendicular to the length direction thereof, said third and fourth antennas being disposed perpendicular to said first and second antennas;

first phase shifting means for adjusting phases of received signals from said first and second antennas and combining the phase-adjusted signals in such a manner that the resultant signal selectively assumes a first directivity state in which said resultant signal exhibits a directivity in a first direction which is from said first antenna toward said second antenna, and a second directivity state in which said resultant signal exhibits a directivity in a second direction which is from said second antenna toward said first antenna;

second phase shifting means for adjusting phases of received signals from said third and fourth antennas and combining the phase-adjusted signals in such a manner that the resultant signal selectively assumes a third directivity state in which said resultant signal exhibits a directivity in a third direction which is from said third antenna toward said fourth antenna, and a fourth directivity state in which said resultant signal exhibits a directivity in a fourth direction which is from said fourth antenna toward said third antenna; and signal combining means for adjusting in value and combining an output signal of said first phase shifting means in said first or second directivity state and an output signal of said second phase shifting means in said third or fourth directivity state, and providing an output signal exhibiting a directivity in a selected one of said first through fourth directions and directions between said first through fourth directions.

6. The variable directivity antenna according to claim 5 wherein said signal combining means comprises:

first level adjusting means to which an output signal of said first phase shifting means is applied;

second level adjusting means to which an output signal of said second phase shifting means is applied; and combining means for combining output signals of said first and second level adjusting means;

said first and second level adjusting means selectively assuming a first factor state in which a signal inputted thereto is outputted with a level proportional to a first factor, a second factor state in which a signal inputted thereto is outputted with a level proportional to a second factor smaller than said first factor, and an intercepting state in which an inputted signal is intercepted;

said variable directivity antenna further comprising:

level control signal generating means for providing first and second level control signals to said first and second level adjusting means so as to successively place said first and second level adjusting means in: a first step in which said first level adjusting means assumes the first factor state, and said second level adjusting means assumes the intercepting state; a second state in which said first level adjusting means assumes the first factor state, and said second level adjusting means assumes the second factor state; a third step in which said first and second level adjusting means assume the first factor state; a fourth step in which said first level adjusting means assumes the second factor state, and said second level adjusting means assumes the first factor state; a fifth step in which the first level adjusting means is in the intercepting state, and said second level adjusting means assumes the first factor state; a sixth step in which said first level adjusting means assumes the second factor state, and said second level adjusting means assumes the first factor state; a seventh step in which said first and second level adjusting means assume the first factor state; and an eighth step in which said first level adjusting means assumes the first factor state, and said second level adjusting means assumes the second factor state.

7. The variable directivity antenna according to claim 6, further comprising directivity control signal generating means providing said first and second antenna groups with directivity control signals, which, in said first through fourth steps, places the directivities of said first and second antenna groups selectively in a state in which the directivity of said first antenna group is in said first directivity state and the directivity of said second antenna group is in said third directivity state, and a state in which the directivity of said first antenna group is in the second directivity state and the directivity of said second antenna group is in the fourth directivity state, and which, in said fifth through eighth steps, places the directivities of said first and second antenna groups selectively in a state in which the directivity of said first antenna group is in said second directivity state and the directivity of said second antenna group is in said third directivity state, and a state in which the directivity of said first antenna group is in the first directivity state and the directivity of said second antenna group is in the fourth directivity state.

8. The variable directivity antenna according to claim 5 wherein said first through fourth antennas are first through fourth dipole antennas having their entire lengths so selected as to receive a radio wave in the first frequency band; extension elements are disposed in line with and outward of opposite ends of each said dipole antennas; the sum of the lengths of each of said first through fourth dipole antennas and said extension elements disposed outward of that dipole antenna is such as to receive a radio wave in a second frequency band lower than said first frequency band; and switch means are connected between said first dipole antenna and said extension elements disposed outward of said first dipole antenna, between said second dipole antenna and said extension elements disposed outward of said second dipole antenna, between said third dipole antenna and said extension elements disposed outward of said third dipole antenna, and between said fourth dipole antenna and said extension elements disposed outward of said fourth dipole antenna;

said variable directivity antenna further comprising switching control means, which opens said switch means when a radio wave in the first frequency band is to be received, and closes said switch means when a radio wave in the second frequency band is to be received.

9. The variable directivity antenna according to claim 8 further comprising:

variable filter means comprising a first variable filter to which a received signal from said first antenna group is applied and which has a passband changed to a selected one of the first and second frequency bands in accordance with a first passband varying signal, and a second variable filter to which a received signal from said second antenna group is applied and which has a passband changed in accordance with a second passband varying signal; and passband varying signal generating means for providing said first and second filter means with said first and second passband varying signals.

10. The variable directivity antenna system according to claim 9 wherein, when said level control signal generating means and said directivity control signal generating means are generating such first and second level control signals and directivity control signals as to provide said antenna system with a directivity to receive a desired radio wave, said passband varying signal generating means provides said first and second variable filters with such first and second passband varying signals as to make said first and second variable filters pass said desired radio wave.

11. The variable directivity antenna system according to claim 10 further comprising a receiving apparatus to which a received signal is coupled from said antenna system through a transmission line, said receiving apparatus transmitting antenna control data corresponding to a channel in which a signal to be received is being transmitted through said transmission line.

12. The variable directivity antenna system according to claim 11 wherein said receiving apparatus has memory means for storing therein said antenna control data and data relating to said channel in correlation with each other, the first and second level control signals, the directivity control signals, and the first and second passband varying signals corresponding to the desired channel are generated in accordance with said antenna control data; and in a state when said receiving apparatus is receiving said desired channel, said antenna control data for the desired channel is read out of said memory means, and transmitted through said transmission line to said level control signal generating means, said directivity control signal generating means, and said passband varying signal generating means.

13. The variable directivity antenna system according to claim 12 wherein:

after said receiving apparatus is set to be able to receive said desired channel, and while said first and second passband varying signals are being supplied to said first and second variable filters so as to make said first and second variable filters pass said desired channel therethrough, said first and second level control signals and said directivity control signals are varied, while monitoring a signal receiving condition at said receiving apparatus, to determine the first and second level control signals and directivity control signals which provide an allowable receiving condition; and data relating to the thus determined first and second level control signals and directivity control signals, and data relating to the first and second passband varying signals supplied to said passband varying signal generating means when an allowable receiving condition has been attained, are stored as said antenna control data in said memory means.

14. The variable directivity antenna system according to claim 12 wherein:

when a state in which said desired channel signal is received at said receiving apparatus becomes intolerable, while the first and second passband varying signals are being applied to said first and second variable filters so as to make said first and second variable filters pass said desired channel signal therethrough, the first and second level control signals and said directivity control signals are successively changed, with the signal receiving condition at said receiving apparatus being monitored, to determine said first and second level control signals and directivity control signals which provide an allowable signal receiving condition; and said first and second level control signals and directivity control signals providing said allowable signal receiving condition are substituted for the previous data relating to said first and second level control signals and directivity control signals in said antenna control data.

15. The variable directivity antenna system according to claim 5 wherein received signals from said first through fourth antennas are amplified by respective associated amplifying means.

16. The variable directivity antenna system according to claim 5 wherein said first and second antennas are formed on a first printed circuit board, and said third and fourth antennas are formed on a second printed circuit board.

* * * * *